US009452878B2

(12) United States Patent
Baker et al.

(10) Patent No.: US 9,452,878 B2
(45) **Date of Patent: *Sep. 27, 2016**

(54) FOOTWEAR CUSTOMIZATION KIT

(71) Applicant: Nike, Inc., Beaverton, OR (US)

(72) Inventors: Brian D. Baker, Portland, OR (US); Alexandre Baudouin, Portland, OR (US); William M. Dieter, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 227 days.

This patent is subject to a terminal disclaimer.

(21) Appl. No.: 14/136,352

(22) Filed: Dec. 20, 2013

(65) Prior Publication Data

US 2014/0174967 A1 Jun. 26, 2014

Related U.S. Application Data

(62) Division of application No. 12/621,624, filed on Nov. 19, 2009, now Pat. No. 8,627,528.

(51) Int. Cl.
*B65D 85/00* (2006.01)
*B65D 85/18* (2006.01)
(Continued)

(52) U.S. Cl.
CPC ..... *B65D 85/187* (2013.01); *A43B 7/1465* (2013.01); *A43D 3/1408* (2013.01)

(58) Field of Classification Search
CPC ..... A43B 7/28; A43B 23/02; A43D 3/00; A43D 3/1408; A43D 95/12; A47G 23/02; B65D 85/187
USPC ..... 206/223, 278; 248/95, 152, 174; 425/470; 12/123–129.4, 142 R, 142 G, 12/142 T; 36/103, 136, 147; 66/190
See application file for complete search history.

(56) References Cited

U.S. PATENT DOCUMENTS 1,047,882 A 12/1912 Beach
1,052,187 A 2/1913 Stranders
(Continued)

FOREIGN PATENT DOCUMENTS

CN 200973696 11/2007
DE 29804716 5/1998
DE 19825615 7/1999

OTHER PUBLICATIONS http://www.nicetoys.com/displayacryliceaselstands.html Hinged Easel-Plate Stands, 2009.
(Continued)

*Primary Examiner* — Bryon Gehman
(74) *Attorney, Agent, or Firm* — Plumsea Law Group, LLC

(57) ABSTRACT

A footwear customization kit includes a stand for supporting an article of footwear that has a customizable portion that can be deformed when heated, and a steaming bag. The stand may include first and second members that can be assembled to support the article of footwear in the steaming bag over a steam environment by engaging an outer periphery of a steaming vessel. The first member may include a first center projection, a first lower central surface, and engaging slots formed in the first lower central surface. The second member may include a second center projection, a second lower central surface, a pair of second shoulders, third and fourth arms disposed above the second lower central surface, and receiving slots formed in upper surfaces of the second shoulders. The first and second members may be attached by interlocking engagement of the engaging slots and the receiving slots.

4 Claims, 17 Drawing Sheets

(51) Int. Cl.
*A43D 3/14* (2006.01)
*A43B 7/14* (2006.01)

(56) References Cited

U.S. PATENT DOCUMENTS

| | | | | | |
|---|---|---|---|---|---|
| 1,091,026 | A | | 3/1914 | Traugott | |
| 1,170,541 | A | * | 2/1916 | Jacobus | A47F 7/148 248/174 |
| 1,522,107 | A | | 1/1925 | Deming | |
| 1,822,297 | A | * | 9/1931 | Kemery | A42C 3/04 248/174 |
| 2,098,735 | A | * | 11/1937 | Yentis | A43D 95/10 12/123 |
| 2,103,748 | A | | 12/1937 | Horr | |
| 2,335,020 | A | | 11/1943 | Nehrich | |
| 2,440,393 | A | * | 4/1948 | Clark | A43B 1/02 12/142 G |
| 2,617,204 | A | * | 11/1952 | Mann | A43D 3/1408 12/129.4 |
| 2,648,854 | A | * | 8/1953 | Otsuka | A43B 9/06 12/142 K |
| 2,767,855 | A | * | 10/1956 | Brown | A47F 7/08 248/152 |
| 2,916,843 | A | | 12/1959 | Meyer | |
| 3,058,237 | A | * | 10/1962 | King | A63H 33/3072 434/260 |
| 3,241,660 | A | * | 3/1966 | Cathcart, Jr. | A47F 5/112 248/152 |
| 3,535,418 | A | | 10/1970 | Daum et al. | |
| 3,586,279 | A | * | 6/1971 | Benson | A47F 7/142 248/174 |
| 3,611,501 | A | | 10/1971 | Daum et al. | |
| D227,326 | S | | 6/1973 | Venuta | |
| 3,848,287 | A | | 11/1974 | Simonsen | |
| 4,450,759 | A | | 5/1984 | Steibel | |
| 4,901,390 | A | | 2/1990 | Daley | |
| 4,964,229 | A | | 10/1990 | Laberge | |
| 5,003,708 | A | | 4/1991 | Daley | |
| 5,080,237 | A | * | 1/1992 | Hefner | B08B 11/02 211/12 |
| 5,083,910 | A | | 1/1992 | Abshire et al. | |
| 5,123,180 | A | | 6/1992 | Nannig et al. | |
| 5,188,244 | A | * | 2/1993 | Hollstegge | D06F 59/00 211/85.15 |
| 5,516,072 | A | * | 5/1996 | Shinno | A47G 1/142 248/174 |
| 5,714,098 | A | | 2/1998 | Potter | |
| 5,733,647 | A | | 3/1998 | Moore, III et al. | |
| 5,746,015 | A | | 5/1998 | Clement et al. | |
| 5,797,862 | A | | 8/1998 | Lamont | |
| 5,879,725 | A | | 3/1999 | Potter | |
| 5,885,622 | A | | 3/1999 | Daley | |
| 6,026,595 | A | | 2/2000 | Curry | |
| 6,247,250 | B1 | | 6/2001 | Hauser | |
| 6,346,210 | B1 | | 2/2002 | Swartz et al. | |
| D470,149 | S | | 2/2003 | West | |
| 6,703,142 | B2 | | 3/2004 | Snow | |
| 7,008,386 | B2 | | 3/2006 | Alaimo et al. | |
| 7,257,907 | B2 | | 8/2007 | Green | |
| 7,458,173 | B2 | | 12/2008 | Kielt et al. | |
| D627,990 | S | | 11/2010 | Shea | |
| 7,958,993 | B2 | * | 6/2011 | Baker | A43B 7/28 12/129.4 |
| 8,033,393 | B2 | * | 10/2011 | Baker | A43D 95/12 206/278 |
| 8,627,528 | B2 | | 1/2014 | Baker et al. | |
| 2002/0050080 | A1 | | 5/2002 | Vasyli | |
| 2004/0031169 | A1 | | 2/2004 | Jensen et al. | |
| 2004/0194348 | A1 | | 10/2004 | Campbell et al. | |
| 2004/0194352 | A1 | | 10/2004 | Campbell et al. | |
| 2005/0262757 | A1 | | 12/2005 | Wong et al. | |
| 2006/0049181 | A1 | | 3/2006 | Tuhkru et al. | |
| 2008/0034616 | A1 | | 2/2008 | Rhenter | |
| 2009/0044426 | A1 | | 2/2009 | Levine | |
| 2010/0064903 | A1 | | 3/2010 | Spence | |

OTHER PUBLICATIONS http://www.nicetoys.com/baracrylichingedeasel-platestands.html
Nicetoys.com, Acrylic Plate Stands, 2009.
International Search Report and Written Opinion mailed Apr. 13, 2011 in International Application No. PCT/US2010/057017.
International Preliminary Report on Patentability (including Written Opinion of the ISA) mailed May 31, 2012 in International Application No. PCT/US2010/057017.

* cited by examiner

FOOTWEAR CUSTOMIZATION KIT

CROSS-REFERENCE TO RELATED APPLICATION

This application is a divisional application of, and claims priority to, U.S. patent application Ser. No. 12/621,624, which was filed in the United States Patent and Trademark Office on 19 Nov. 2009 and entitled FOOTWEAR CUSTOMIZATION KIT, and issued as U.S. Pat. No. 8,627,528 on Jan. 14, 2014, such prior U.S. Patent Application being incorporated herein by reference in its entirety.

BACKGROUND

The present invention relates generally to an article of footwear, and in particular to a customization kit for an article of footwear.

Tuhkru et al. (U.S. Patent Application Publication Number 2006/0049181) teaches a perfect fit system for leather shoes. Tuhkru teaches a system that uses two heating bags filled with sea salt. Tuhkru teaches microwaving the bags for several minutes and then placing the bags inside of a pair of shoes. The shoes can be placed in a heat conservation bag. The process is completed by cooling the heated shoes on the foot.

Laberge (U.S. Pat. No. 4,964,229) teaches a method and apparatus for vacuum molding multi-layer footwear. Laberge teaches multi-layer footwear formed of laminated layers of material. The layers are capable of being heating to a degree at which the footwear, when placed in a vacuum bag or compression chamber, is molded to adopt the shape of the foot inside the footwear. The footwear is heated to the point where the synthetic components of the layers of material are flexible under thermoforming conditions.

Simonsen (U.S. Pat. No. 3,848,287) teaches a method and apparatus for custom molding boots and shoes. Simonsen teaches a boot or shoe formed of a thermoplastic material. To better conform it to the wearer's foot, the wearer puts his foot within the boot and places it within a bag of a plastic material having a melting temperature higher than the molding temperature of the boot. A vacuum line is also placed within the bag and the top of the bag is sealed around the user's leg.

The related art lacks provisions for allowing a user to easily customize an article of footwear. There is a need for a design that addresses this problem of the related art.

SUMMARY

In one aspect, the invention provides a stand for holding an article of footwear in a steam environment, comprising: a first member; a second member; the first member further including a first center projection and at least two engaging slots; the second member further including a second center projection and at least two receiving slots; wherein the first member and the second member each have a flattened position and a folded position along a longitudinal axis; and wherein the first member in the folded position is attached to the second member in the folded position by engagement of the at least two engaging slots with the at least two receiving slots.

In another aspect, the invention provides a stand for holding an article of footwear in a steam environment, comprising: a first member including a first center projection, a first arm, a second arm, and at least two engaging slots; a second member including a second center projection, a third arm, a fourth arm, and at least two receiving slots; wherein the first member and the second member each have a flattened position and a folded position along a longitudinal axis; wherein the first member in the folded position is attached to the second member in the folded position by engagement of the at least two engaging slots with the at least two receiving slots; and wherein the first arm and the second arm extend outward from the first member at a first alignment and the third arm and the fourth arm extend outward from the second member at a second alignment.

In another aspect, the invention provides kit of parts, comprising: a container; a stand for holding an article of footwear in a steam environment; a steaming bag configured to cover the article of footwear and the stand in the steam environment; and wherein the stand includes: a first member including at least two engaging slots; a second member including at least two receiving slots; wherein the first member and the second member each have a flattened position and a folded position along a longitudinal axis; and wherein the first member in the folded position is attached to the second member in the folded position by engagement of the at least two engaging slots with the at least two receiving slots.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

FIGS. 1 through 4 illustrate an embodiment of footwear customization kit 100, also referred hereafter as kit 100. Footwear customization kit 100 can be used with any type of footwear. In addition, the principles discussed throughout this detailed description may not be limited in use to footwear. Similar principles could be applied to customization kits for various different types of apparel as well.

In some embodiments, footwear customization kit 100 may used by a customer at home. For example, in some cases, a customer could purchase footwear customization kit 100 at a retail location and bring kit 100 home. In other cases, kit 100 may be shipped to an address associated with the customer. In other embodiments, footwear customization kit 100 could be used at any other location, such as a retail store or a kiosk.

Figure 1:
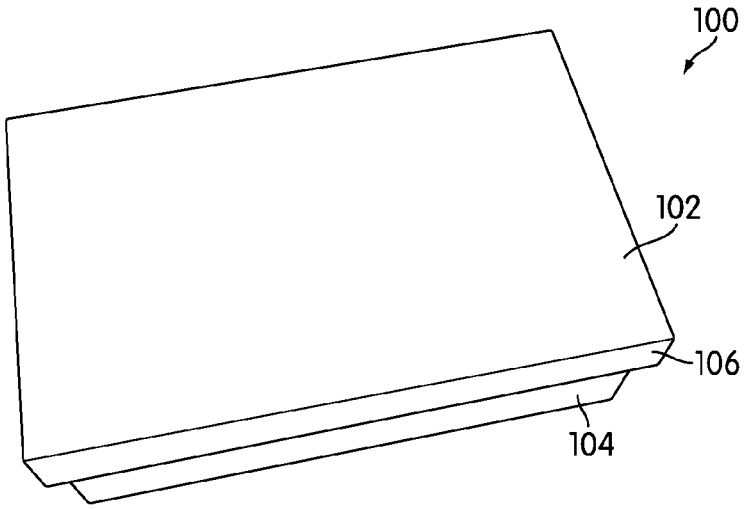
FIG. 1 is an isometric view of an embodiment of a container for a footwear customization kit.

Kit 100 may include container 102, which is shown in a closed position in FIG. 1. Container 102 can be any type of container configured to store at least one article of footwear. In some cases, container 102 may be a box. In an exemplary embodiment, container 102 may be a shoebox that is configured to store footwear. In particular, container 102 may have a generally rectangular shape and can include lower portion 104 and lid 106.

Figure 2:
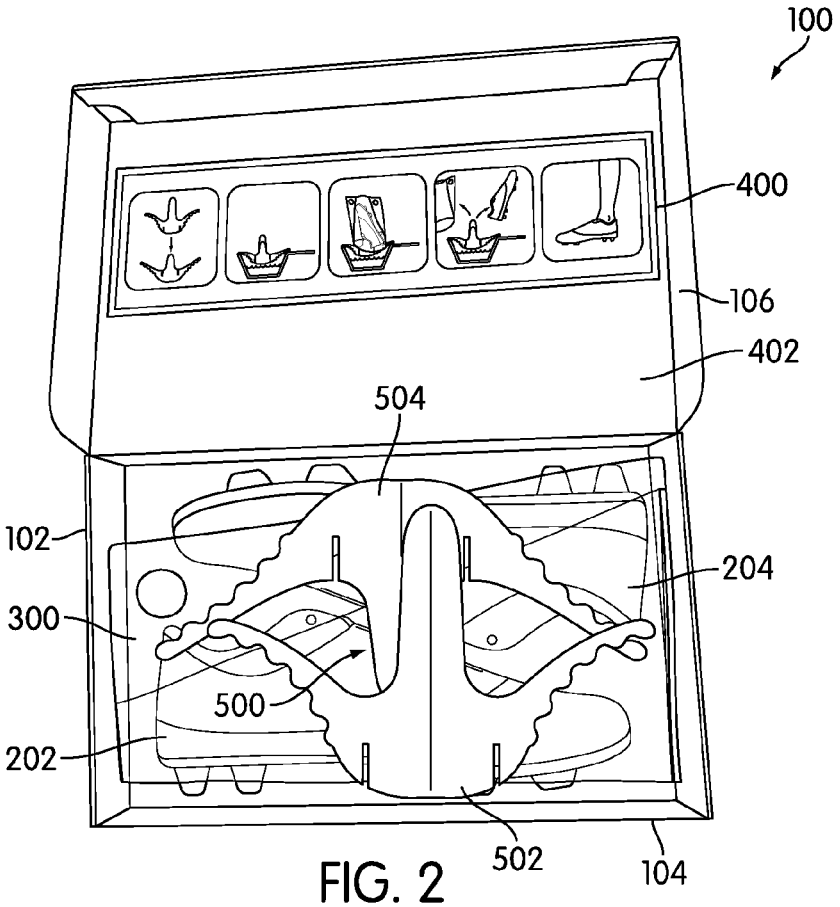
FIG. 2 is a top down view of an embodiment of a footwear customization kit.
Figure 3:
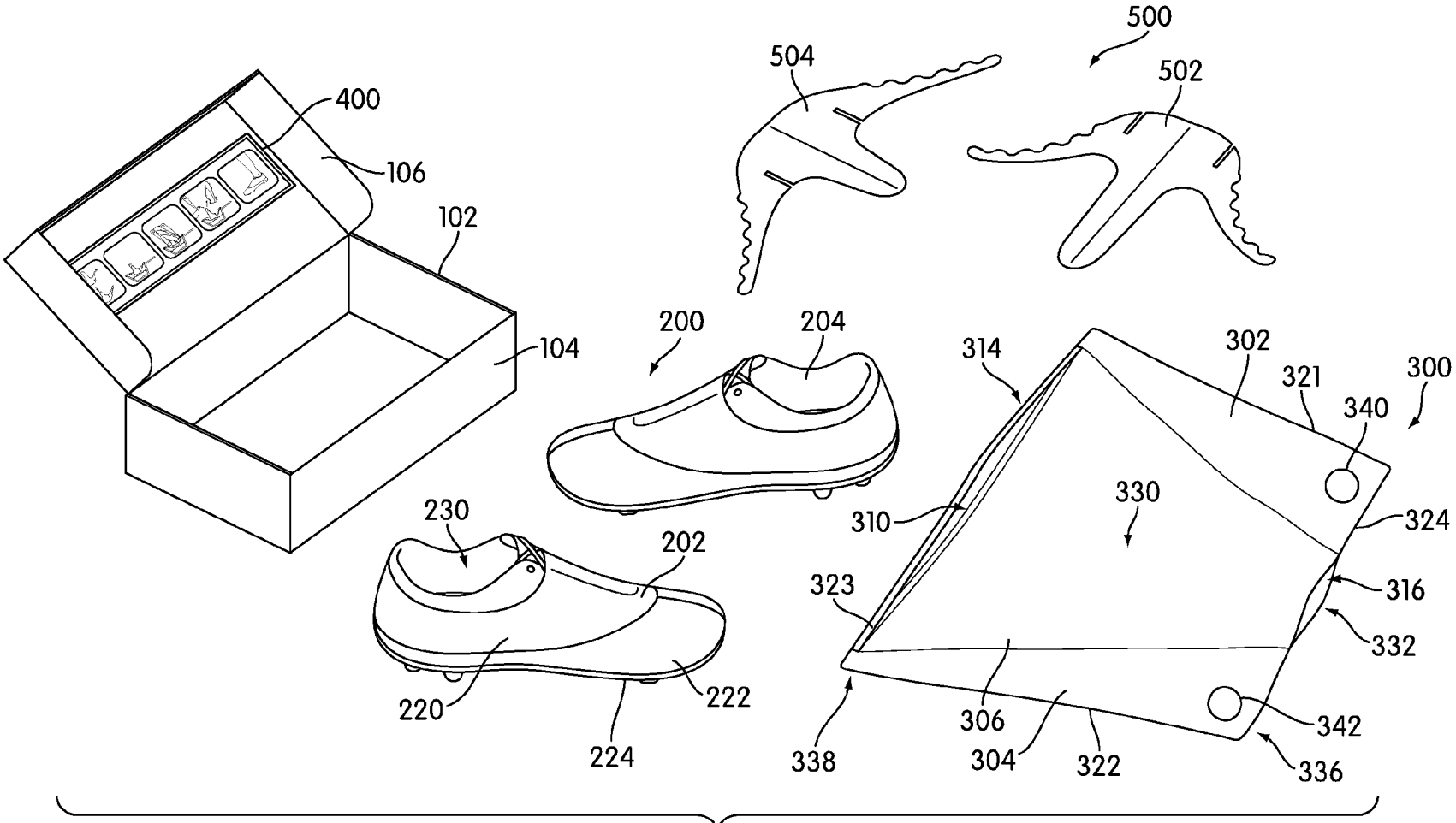
FIG. 3 is an isometric view of an embodiment of a footwear customization kit with the components outside of the container.
Figure 4:
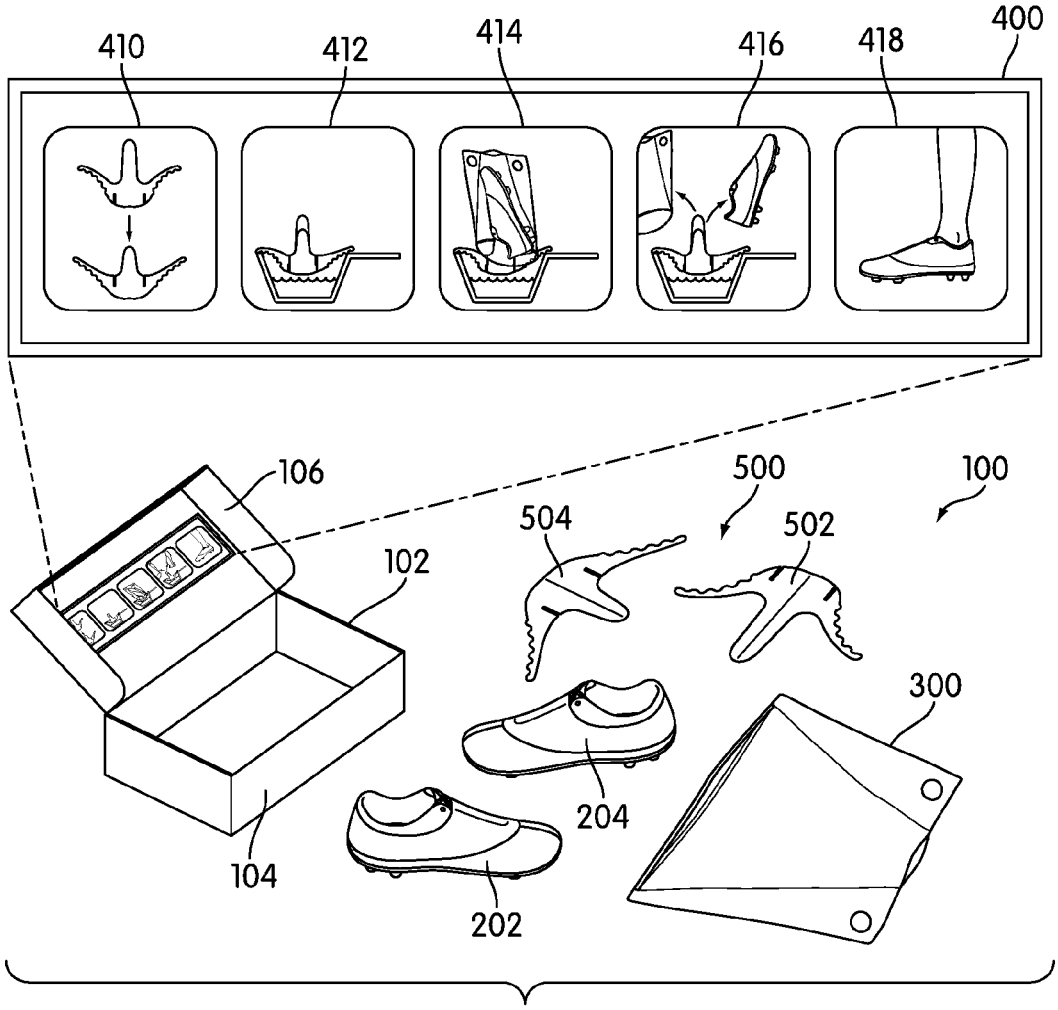
FIG. 4 is an isometric enlarged view of an embodiment of a set of instructions associated with a footwear customization kit.

Referring to FIGS. 2 through 4, kit 100 can include various different components for customizing one or more articles of footwear. In one embodiment, kit 100 can include pair of footwear 200. Pair of footwear 200 may further comprise first article of footwear 202 and second article of footwear 204. Generally, articles of footwear associated with kit 100 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 100 may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

First article of footwear 202 and second article of footwear 204 may be oriented for a left foot and a right foot, respectively. For purposes of clarity, the following detailed description discusses first article of footwear 202, but it will be understood that each of the features discussed for first article of footwear 202 could also apply to second article of footwear 204. Furthermore, first article of footwear 202 may also be referred to as article 202 throughout the remainder of this detailed description.

A footwear customization kit 100 can include provisions to facilitate steaming an article of footwear for modifying one or more customizable portions. As shown in FIG. 2, in one embodiment, footwear customization kit 100 can include stand 500 for holding article 202 above or within a steaming device (not shown). Stand 500 can include a first member 502 and a second member 504. First member 502 and second member 504 may be configured to attach to form stand 500. First member 502 and second member 504 may include portions configured to rest against a portion of a steaming device that is used for creating a steam environment. For example, in embodiments where the steaming device is a pot, first member 502 and second member 504 may rest against an outer periphery of the pot.

In some embodiments, first member 502 and second member 504 of stand 500 may be configured to fit within container 102. In other words, the dimensions of first member 502 and second member 504 may be selected to allow stand 500 to be packed within container 102 in an unassembled state. In particular, first member 502 and second member 504 may be oriented so that the longer portions extend along the length of container 102.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot portion to a heel portion of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Referring to FIG. 3, article 202 can include upper 222. Generally, upper 222 may be any type of upper. In particular, upper 222 may have any design, shape, size and/or color. For example, in embodiments where article 202 is a basketball shoe, upper 222 could be a high top upper that is shaped to provide high support on an ankle. In embodiments where article 202 is a running shoe, upper 222 could be a low top upper.

Article 202 can include sole structure 224. In some embodiments, sole structure 224 may be configured to provide traction for article 202. In addition to providing traction, sole structure 224 may attenuate ground reaction forces when compressed between the foot and the ground during walking, running or other ambulatory activities. The configuration of sole structure 224 may vary significantly in different embodiments to include a variety of conventional or non-conventional structures. In some cases, the configuration of sole structure 224 can be configured according to one or more types of ground surfaces on which sole structure 224 may be used. Examples of ground surfaces include, but are not limited to: natural turf, synthetic turf, dirt, as well as other surfaces.

Sole structure 224 extends between the foot and the ground when article 202 is worn. In different embodiments, sole structure 224 may include different components. For example, sole structure 224 may include an outsole, a midsole, and/or an insole. In some cases, one or more of these components may be optional.

Article 202 can be configured with one or more customizable portions. The term "customizable portion" as used throughout this detailed description and in the claims refers to a portion with characteristics that can be customized. Examples of such characteristics include, but are not limited to, size, shape, material properties (such as rigidity and/or flexibility) as well as other properties. In an exemplary embodiment, a customizable portion may a portion with a size and/or shape that can be adjusted. In addition, in some cases, the material properties of a customizable portion could also be adjusted.

The characteristics of customizable portions can be varied in different ways. In some embodiments, a customizable portion can be varied through a curing process. In other words, the customizable portion may be heated above a predetermined temperature and modified before cooling the customizable portion so that the modifications are retained. In other embodiments, the characteristics of customizable portions can be varied through the use of pressure, chemical additives or other known methods of changing the characteristics of material including the size, shape, rigidity, flexibility and/or other properties. In still other embodiments, a combination of heat, pressure and/or chemicals could be used to modify the customizable portion.

Generally, article 202 can comprise one or more customizable portions. In some embodiments, sole structure 224 may be associated with one or more customizable portions. In other embodiments, upper 222 may be associated with one or more customizable portions. In some cases, a customizable portion may be associated with a forefoot portion 10, midfoot portion 12 and/or heel portion 14 of upper 222. In other cases, a customizable portion may be associated with any combination of different portions of upper 222. In an exemplary embodiment, upper 222 may include customizable portion 220. In particular, customizable portion 220 may extend through a substantial majority of upper 222. In some cases, customizable portion 220 may coincide with upper 222. Using this arrangement, upper 222 may be custom shaped to the specific geometry of the foot of a user to enhance comfort and fit.

In different embodiments, customizable portions can be made from any known materials or combination of materials. Examples of materials that may be used include, but are not limited to: any kind of thermoset polymers, thermoplastics, thermoset resins (such as epoxy, vinlyester and polyster), synthetic leathers including poromeric leathers and lorica, as well as any other kinds of materials with customizable characteristics. In an exemplary embodiment, a customizable portion may be constructed as a synthetic leather comprising two polymer layers that sandwich a canvas sheet. Moreover, a glue used to bond the polymer layers to the canvas may be configured with a relatively low melting point. When steamed, this glue can stretch or shrink to accommodate a customized shape. Although the current embodiment discusses a three-layered construction, other customizable portions could incorporate any other number of layers including a single layer construction.

In order to modify customizable portion 220, article 202 may be heated above a predetermined temperature. For example, in embodiments where a customizable portion may transition between a crystalline phase and a liquid like phase, the predetermined temperature can be a glass transition temperature. In some cases, the glass transition temperature is useful in characterizing amorphous solids such as plastics or similar materials that may not have a true melting point. However, in other cases, the predetermined temperature can be some other temperature at which a customizable portion may become substantially more deformable. In some cases, article 202 may be placed in an oven. In other cases, article 202 may be heated using steam. In an exemplary embodiment, article 202 may be heated in any steam environment. A steam environment can be created in different ways. In some cases, a steam environment can be created using a pot with water that may be boiled to create steam. In other cases, any other devices or mechanisms for creating steam can be used. By selecting materials for a customizable portion that become substantially more deformable at temperatures less than or equal to the temperature of steam, a customizable portion can be activated by applying steam to an article of footwear.

Referring back to FIG. 3, kit 100 can include steaming bag 300. In some embodiments, steaming bag 300 may comprise first peripheral edge 321, second peripheral edge 322, third peripheral edge 323 and fourth peripheral edge 324. Furthermore, steaming bag 300 may comprise central portion 306 that includes interior cavity 310. In some cases, steaming bag 300 may further comprise first peripheral portion 302 and second peripheral portion 304 that extend from central portion 306 to first peripheral edge 321 and second peripheral edge 322, respectively. First peripheral portion 302 and second peripheral portion 304 may include first end portions 336 disposed adjacent to fourth peripheral edge 324 and second end portions 338 disposed adjacent to third peripheral edge 323. In addition, third peripheral edge 323 may include peripheral opening 314 that provides access to interior cavity 310 of central portion 306. In some, but not all embodiments, fourth peripheral edge 324 may include vent 316 that provides a secondary access for central portion 306. In other words, vent 316 is an optional opening and may not be included in all embodiments.

In some embodiments, the shapes of first peripheral portion 302 and second peripheral portion 304 may vary. In some cases, first peripheral portion 302 and second peripheral portion 304 may be substantially rectangular portions or strip like portions with constant widths. In other cases, first peripheral portion 302 and second peripheral portion 304 may have variable widths. In an exemplary embodiment, for example, first end portions 336 of first peripheral portion 302 and second peripheral portion 304 may be substantially wider than second end portions 338 of first peripheral portion 302 and second peripheral portion 304. In other words, first peripheral portion 302 and second peripheral portion 304 are much larger at first end portions 336 than at second end portions 338. Moreover, this arrangement may provide central portion with a width that tapers from the widest point at third peripheral edge 323 to the narrowest point at fourth peripheral edge 324.

Steaming bag 300 may comprise a substantially elastic material that can be expanded and collapsed when filled with fluids or solid materials. In a first position, steaming bag 300 may have a substantially flat or planar geometry. Furthermore, steaming bag 300 may obtain a three dimensional geometry when filled with a solid object or fluid.

The two dimensional shape corresponding to the first position of steaming bag 300 can vary in different embodiments. In some cases, steaming bag 300 may have a substantially rectangular shape. In other cases, steaming bag 300 may have an approximately trapezoidal shape. Examples of other shapes for steaming bag 300 include, but are not limited to rounded shapes, triangular shapes, polygonal shapes, regular shapes, irregular shapes as well as any other kinds of shapes. In an exemplary embodiment, steaming bag 300 has an approximately trapezoidal shape.

In a second, or expanded, position of steaming bag 300, first side 330 and second side 332 (which is disposed opposite of first side 330) of steaming bag 300 may be separated at central portion 306. In other words, central interior cavity 310 may expand outwardly. In some cases, central portion 306 may have an approximately conical shape when expanded. In contrast to central portion 306, first peripheral portion 302 and second peripheral portion 304 may retain a substantially flattened geometry in this second position. In particular, first side 330 and second side 332 may not separate at first peripheral portion 302 and second peripheral portion 304. Instead, first side 330 and second side 332 may be fixedly attached to one another at first peripheral portion 302 and second peripheral portion 304. This arrangement allows first peripheral portion 302 and second peripheral portion 304 to be used as handles for steaming bag 300. In particular, first peripheral portion 302 and second peripheral portion 304 may retain substantially flattened geometries that may be easier to grasp than central portion 306.

The arrangement discussed here can also provide differing thermal properties for various portions of steaming bag 300. In some cases, first peripheral portion 302 and second peripheral portion 304 may have lower temperatures in a steam environment than central portion 306. This may occur as central portion 306 is filled with steam and thereby heated to a greater temperature than first peripheral portion 302 and second peripheral portion 304 which are not filled with steam.

In some embodiments, steaming bag 300 can include additional provisions for facilitating ease of use. In some cases, steaming bag 300 can include one or more holes that are easily grasped by a user. In an exemplary embodiment, steaming bag 300 can include first grasping hole 340 and second grasping hole 342 that are disposed on first peripheral portion 302 and second peripheral portion 304, respectively. In some cases, first grasping hole 340 and second grasping hole 342 may be disposed adjacent to fourth peripheral edge 324.

As seen in the Figures, container 102 comprises a convenient way of storing each of the components of kit 100. In some cases, each of the components discussed above can be packed into container 102 in the manner illustrated in FIG. 2. In particular, first article of footwear 202 and second article of footwear 204 can be placed into the interior compartment of container 102. Next, steaming bag 300 can be placed in a flattened position over first article of footwear 202 and second article of footwear 204. Finally, first member 502 and second member 504 can be placed on top of steaming bag 300, first article of footwear 202, and second article of footwear 204. With this arrangement, each of the components of kit 100 may be easily stored within container 102.

A footwear customization kit may include provisions for instructing a user about how to customize an article of footwear. In the current embodiment, kit 100 can include set of instructions 400. Generally, set of instructions 400 can be supplied in any format. In some cases, set of instructions 400 may be a printed copy of instructions. For example, in one embodiment, set of instructions 400 could be provided as a booklet that is packed within container 102. In other cases, set of instructions 400 may be associated with a digital storage device. Examples of digital storage devices include, but are not limited to CDs, flash drives, memory disks as well as other types of digital storage devices. In an exemplary embodiment, set of instructions 400 may be given as a set of printed directions. Although the current embodiment illustrates set of instructions 400 as being located on interior surface 402 of lid 106, in other embodiments, set of instructions 400 could be disposed on another portion of container 102. Furthermore, in some cases, set of instructions 400 could be printed in a separate sheet and stored within container 102 rather than being affixed to a portion of container 102. In some embodiments, the instructions may be placed on portions of the device itself, for example, the instructions may be placed on steaming bag 300. In other embodiments, a notice may be placed on the device itself, for example, steaming bag 300, which informs the user to read and follow the instructions. It is possible to provide the instructions in more than one location, for example, set of instructions 400 may be both located on lid 106 and provided as a booklet packed in container 102.

Referring now to FIG. 4, set of instructions 400 may schematically illustrate the steps for customizing an article of footwear. In the current embodiment, set of instructions 400 illustrates five steps for customizing an article of footwear. First panel 410 schematically illustrates the first step, in which a stand is assembled. Next, as illustrated in second panel 412, the assembled stand is placed on a pot of water. Next, as illustrated in third panel 414, an article of footwear may be placed onto the stand and a steaming bag may then be placed over both the stand and the article of footwear. At this point, the water may be boiled and steam may be applied to the article of footwear including the customizable portion. Next, as illustrated in fourth panel 416, the bag may be removed from the article of footwear and the article may be removed from the stand. Finally, as illustrated in fifth panel 418, a user may insert a foot into the article of footwear. At this point, the customizable portion may conform to the shape of the foot as the article of footwear cools.

In some cases, set of instructions 400 can include pictures. In other cases, set of instructions 400 can include written instructions. In other cases, set of instructions 400 can include a combination of pictures and written instructions. Moreover, it will be understood that the instructions discussed and shown in FIG. 4 are only intended to be illustrative and in other embodiments additional steps can be removed or added.

Figure 5:
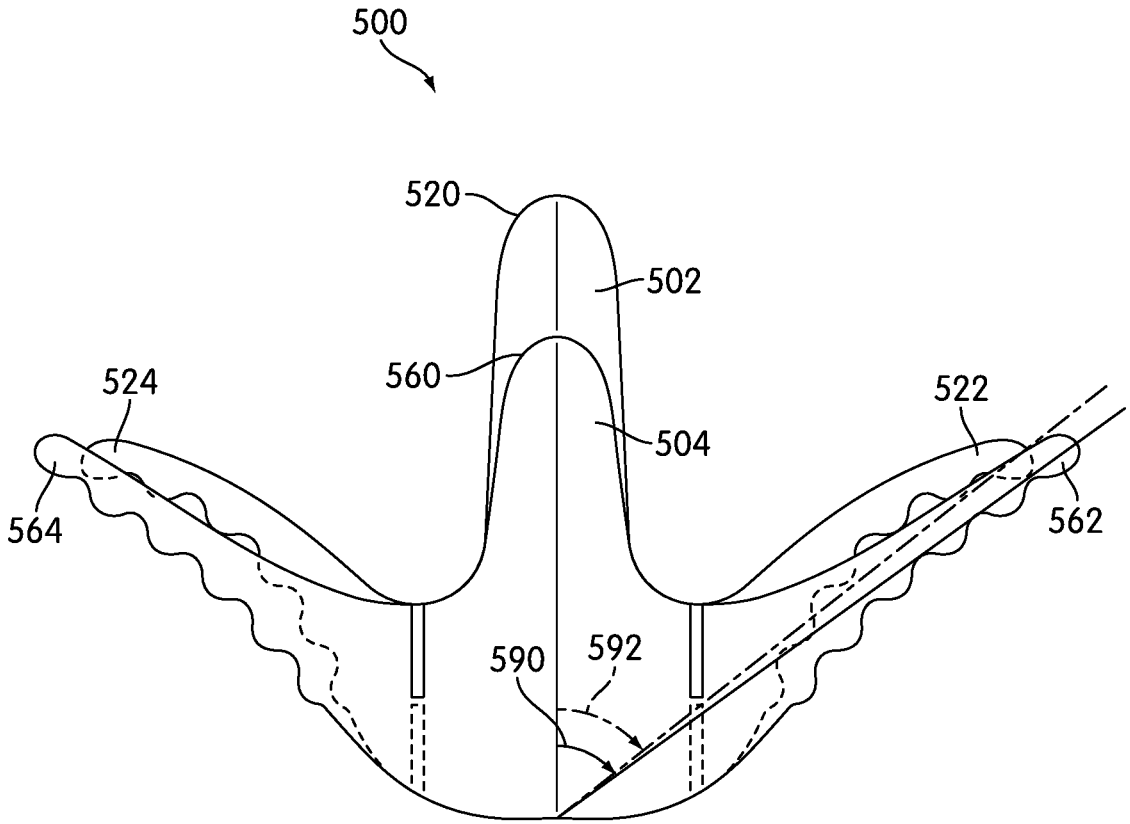
FIG. 5 is an isometric view of an embodiment of an unassembled stand for a footwear customization system.

Referring now to FIG. 5, in an exemplary embodiment of unassembled stand 500, first member 502 and second member 504 are shown overlaid one another. In this embodiment, first member 502 may include a first center projection 520, a first arm 522, and a second arm 524. Second member 504 may include a second center projection 560, a third arm 562, and a fourth arm 564. In this embodiment, first arm 522 and second arm 524 may have a first arm shape and third arm 562 and fourth arm 564 may have a second arm shape. In some cases, the first arm shape and second arm shape may be different. In other cases, the first arm shape and the second arm shape may be approximately the same. In some embodiments, first member 502 and second member 504 may be symmetrical along a longitudinal axis so that first arm 522 and second arm 524 have the same first arm shape and third arm 562 and fourth arm 564 have the same second arm shape. In some cases, the first arm shape and the second arm shape may be designed to hold an article approximately in a center position in a steam environment. In other cases, the first arm shape and the second arm shape may be designed to hold an article in any position in a steam environment.

In some embodiments, the first arm shape and the second arm shape may include an initial angle. As shown in FIG. 5, first arm 522 may have a first initial angle 592 and third arm 562 may have a second initial angle 590. In some cases, first initial angle 592 and second initial angle 590 may be different. In other cases, first initial angle 592 and second initial angle 590 may be approximately the same. In other embodiments, the first shape may include a first curvature of first arm 522 and second arm 524 and the second shape may include a second curvature of third arm 562 and fourth arm 564. In some cases, the first curvature and/or the second curvature may be zero. In different embodiments, the first shape and the second shape may include one or more different combinations of initial angle(s) and/or curvature(s). In other embodiments, first member 502 and/or second member 504 may include various combinations of one or more arms with different arm shapes, including initial angle(s) and/or curvature(s).

In the exemplary embodiment shown in FIG. 5, first center projection 520 of first member 502 and second center projection 560 of second member 504 may be different sizes. In this embodiment, first center projection 520 may be longer than second center projection 560. In other embodiments, first center projection 520 and second center projection 560 may be the same size. In some embodiments, first center projection 520 may be sized and dimensioned to engage an insole portion of an article of footwear and second center projection 560 may be sized and dimensioned to engage an upper portion of an article of footwear. With this arrangement, the first center projection 520 and second center projection 560 may be inserted into a throat opening of an article to hold the article in place and in a generally upright position. In other embodiments, first center projection 520 and second center projection 560 may be sized and dimensioned to engage any portion of an article of footwear.

In different embodiments, the shape of first member 502 and second member 504 may vary. First member 502 and second member 504 may have an approximately two dimensional shape. Examples of different shapes for first member 502 and/or second member 504 include, but are not limited to, rounded shapes, rectangular shapes, polygonal shapes, regular shapes, irregular shapes as well as any other kind of shapes. In the current embodiment, first member 502 and second member 504 may have an approximately symmetrical shape along the longitudinal axis. In addition, first center projection 520 and second center projection 560 may have an approximately two dimensional shape that extends from the respective base portions of first member 502 and second member 504 in a perpendicular manner. Examples of different shapes for first center projection 520 and second center projection 560 include, but are not limited to any of the shapes discussed above for first member 502 and second member 504.

Figure 6:
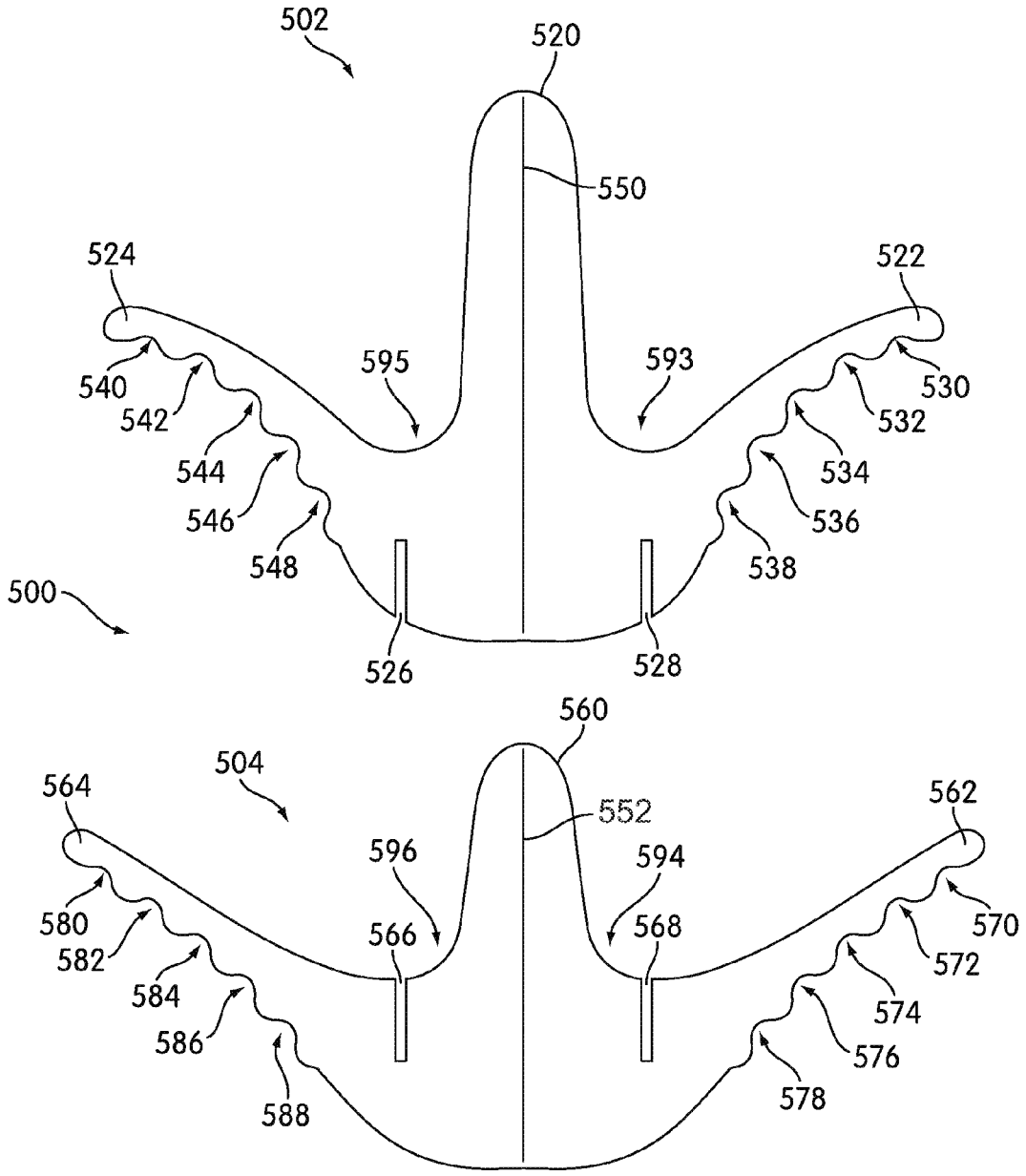
FIG. 6 is an isometric view of an embodiment of the pieces of an unassembled stand for a footwear customization system.

Referring to FIG. 6, first member 502 and second member 504 of stand 500 are shown in a flattened position. In this embodiment, first member 502 includes a first shoulder 593 and a second shoulder 595 and second member 504 includes a third shoulder 594 and a fourth shoulder 596. In some cases, first shoulder 593, second shoulder 595, third shoulder 594, and fourth shoulder 596 may be designed to engage a portion of an article of footwear. In some embodiments, first shoulder 593, second shoulder 595, third shoulder 594, and fourth shoulder 596 may be disposed below at least one of first arm 522, second arm 524, third arm 562, and fourth arm 564. With this configuration, a center of gravity of stand 500 holding an article of footwear may be lowered.

In some embodiments, first member 502 may include first arm 522 and second arm 524. In different embodiments, first arm 522 and second arm 524 may include one or more ridges running along the bottom side forming valleys for resting against an outer periphery of a vessel. In this embodiment, first arm 522 includes first valley 530, second valley 532, third valley 534, fourth valley 536, and fifth valley 538. Similarly, as shown in FIG. 6, second arm 524 includes sixth valley 540, seventh valley 542, eighth valley 544, ninth valley 546, and tenth valley 548.

As shown in the exemplary embodiment in FIG. 6, second member 504 may include third arm 562 and fourth arm 564. Third arm 562 and fourth arm 564 may include one or more ridges running along the bottom side forming valleys for resting against an outer periphery of a vessel. In this embodiment, third arm 562 may include eleventh valley 570, twelfth valley 572, thirteenth valley 574, fourteenth valley 576, and fifteenth valley 578 and fourth arm 564 may include sixteenth valley 580, seventeenth valley 582, eighteenth valley 584, nineteenth valley 586, and twentieth valley 588.

In other embodiments, first arm 522, second arm 524, third arm 562, and fourth arm 564 may each include different numbers of valleys for resting against an outer periphery of vessels of different sizes. In the exemplary embodiment shown in the Figures, the ridges are a wave-like shape and form wave-like valleys. In different embodiments, the ridges and/or valleys may be any shape designed to rest against an outer periphery of a vessel, including, but not limited to triangular, square, rectangular, trapezoidal, and various other geometric shapes and shapes of a regular or irregular nature.

Referring back to FIG. 6, first member 502 may include a first engaging slot 526 and a second engaging slot 528. In this embodiment, first engaging slot 526 and second engaging slot 528 are disposed along the bottom portion of first member 502. In some embodiments, first engaging slot 526 and second engaging slot 528 may extend from the bottom portion of first member 502 towards first center projection 520. In this embodiment, first engaging slot 526 and second engaging slot 528 are sized and dimensioned to fit the thickness of second member 504.

As shown in FIG. 6, second member 504 may include a first receiving slot 566 and a second receiving slot 568. In this embodiment, first receiving slot 566 and second receiving slot 568 are disposed along the top portion of second member 504. In some embodiments, first receiving slot 566 and second receiving slot 568 may extend from the top portion of second member 504 towards the bottom portion.

In this embodiment, first receiving slot 566 and second receiving slot 568 are sized and dimensioned to fit the thickness of first member 502.

In this embodiment, first engaging slot 526, second engaging slot 528, first receiving slot 566, and second receiving slot 568 are arranged approximately in vertical orientations. In other embodiments, first engaging slot 526, second engaging slot 528, first receiving slot 566, and second receiving slot 568 may be arranged in different orientations. In an exemplary embodiment, first engaging slot 526, second engaging slot 528, first receiving slot 566, and second receiving slot 568 may extend a similar length along each of first member 502 and second member 504. In other embodiments, first engaging slot 526, second engaging slot 528, first receiving slot 566, and second receiving slot 568 may extend different lengths along first member 502 and second member 504.

Referring again to FIG. 6, in this embodiment first member 502 may include a first folding crease 550 and second member 504 may include a second folding crease 552. First folding crease 550 and second folding crease 552 may be a region of connection that provides for bending along the longitudinal axis of first member 502 and second member 504. In some cases, first folding crease 550 and second folding crease 552 may be a substantially continuous region of connection. In other cases, first folding crease 550 and second folding crease 552 may comprise gaps or spacing between portions of each of first member 502 and second member 504. In still other cases, first folding crease 550 and second folding crease 552 can have any other configuration that allows for bending along the longitudinal axis of first member 502 and second member 504.

Although the current embodiment illustrates a folding crease along the longitudinal axis of first member 502 and second member 504, in other embodiments any other arrangement that provides bending along the longitudinal axis of first member 502 and second member 504 can be used. In other cases, for example, portions of first member 502 and second member 504 could be joined together along the longitudinal axis using a mechanical hinge of some kind.

Figure 7:
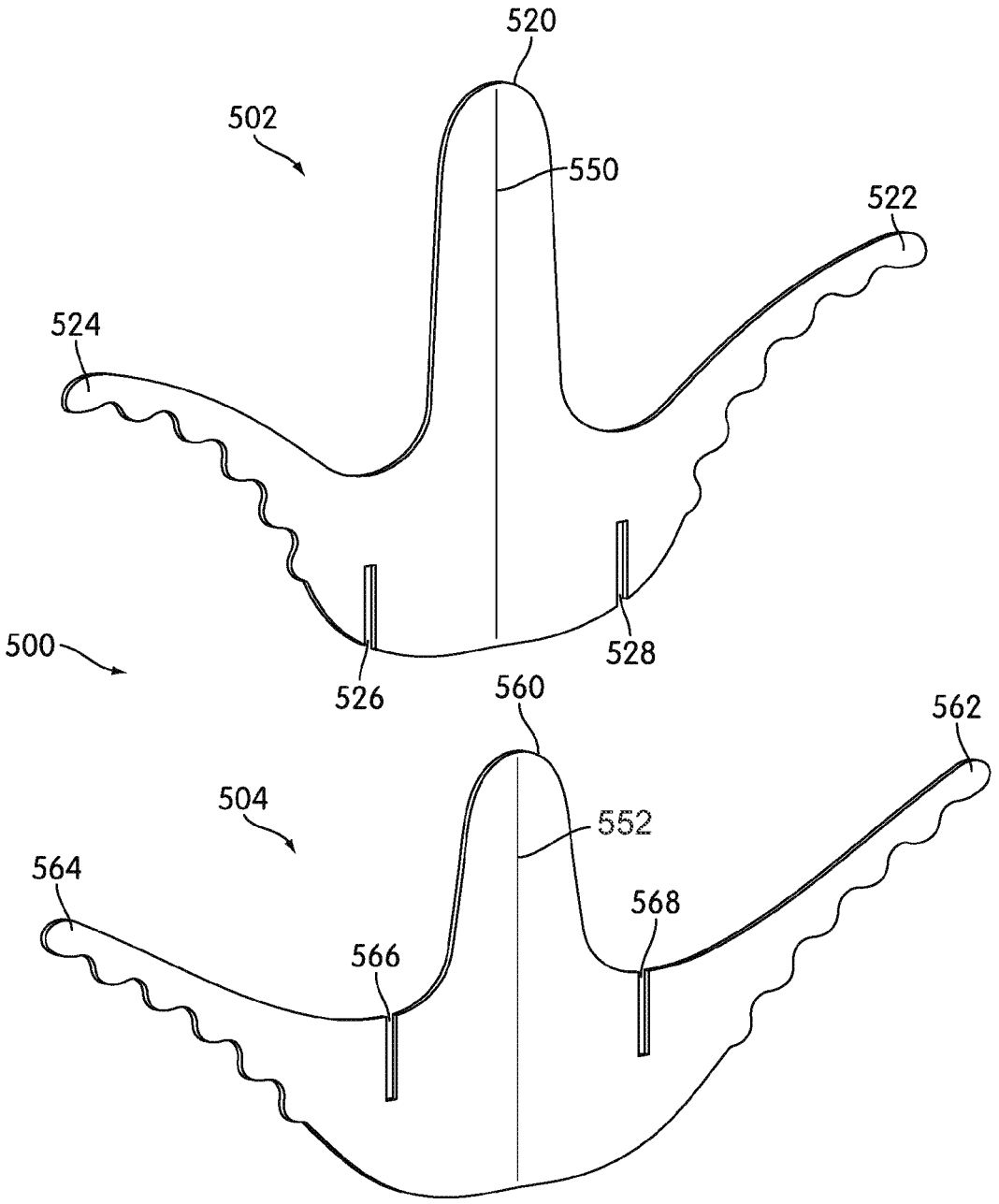
FIG. 7 is an isometric view of an embodiment of the pieces of an unassembled stand for a footwear customization system prepared for assembly.
Figure 8:
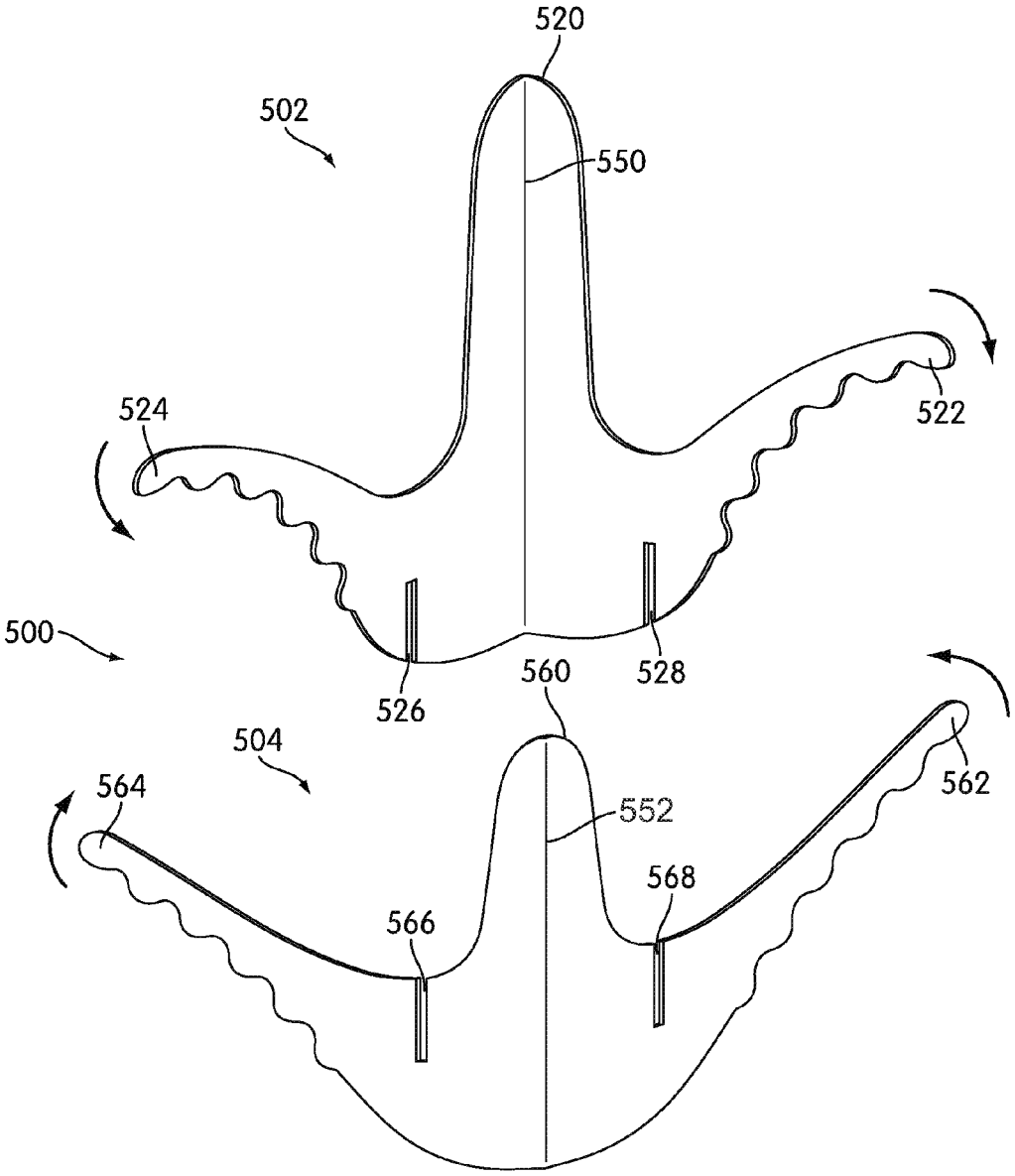
FIG. 8 is an isometric view of an embodiment of the pieces of an unassembled stand for a footwear customization system in the process of assembly.

FIGS. 7-11 illustrate a process of assembly for stand 500. The steps for the process of assembly of stand 500 described in the embodiment shown in FIGS. 7-11 are exemplary and need not be performed in the precise order described below. Referring to FIG. 7, in a first step, first member 502 is aligned with second member 504 so that first engaging slot 526 is aligned with first receiving slot 566 and second engaging slot 528 is aligned with second receiving slot 568. In a second step shown in FIG. 8, first arm 522 and second arm 524 are folded inwards from a flattened position towards each other along first folding crease 550 of first member 502. Similarly, as shown in FIG. 8, third arm 562 and fourth arm 564 are folded inwards from a flattened position towards each other along second folding crease 552 of second member 504.

Figure 9:
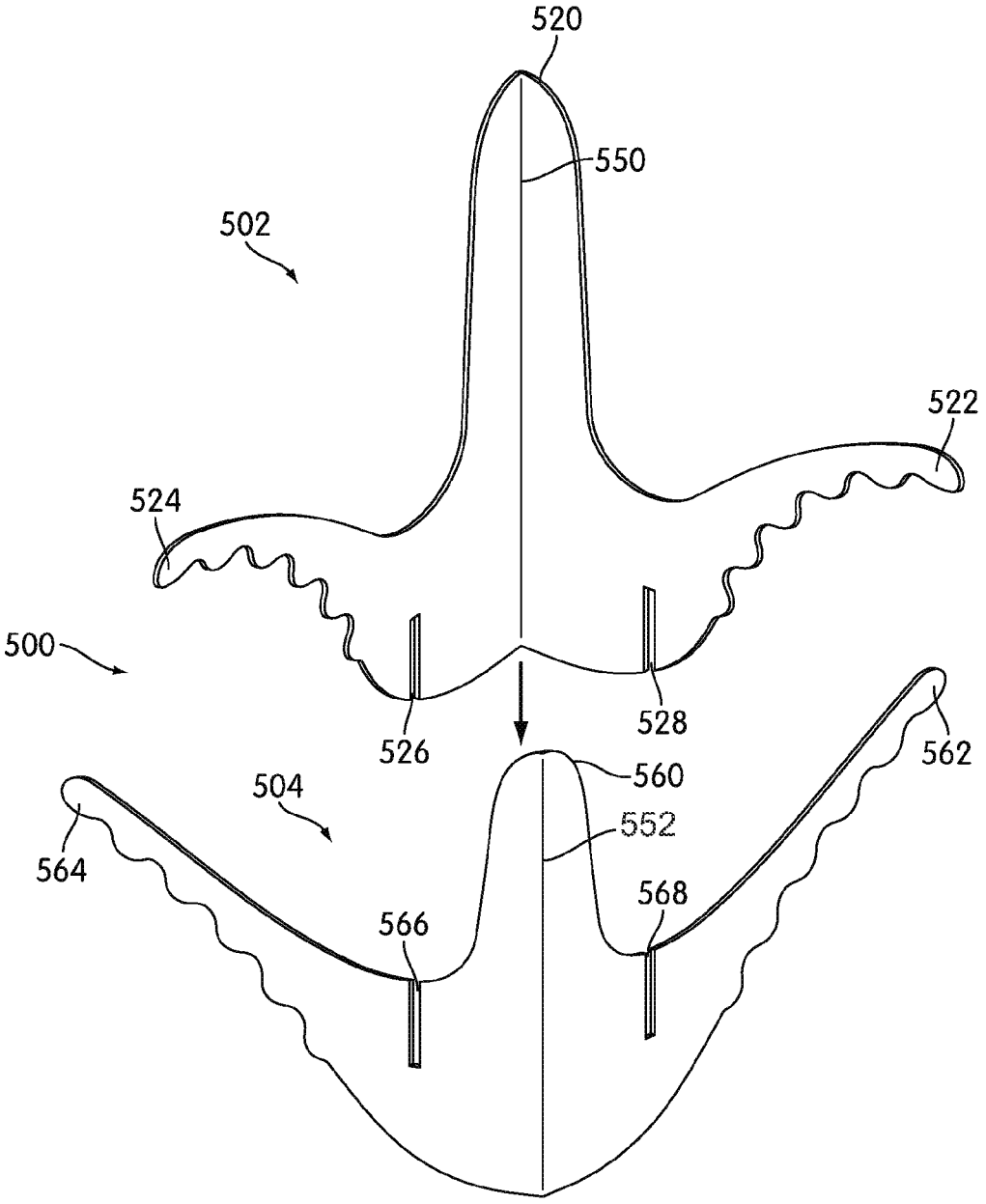
FIG. 9 is an isometric view of an embodiment of the pieces of an unassembled stand for a footwear customization system prepared for attachment.

Referring to FIG. 9, first member 502 is shown in a folded position along first folding crease 550 and second member 504 is shown in a folded along second folding crease 552. In a third step, first member 502 in the folded position is moved towards second member 504 in the folded position. In some embodiments, the folded position of each of first member 502 and second member 504 may form an angle of approximately 90 degrees between the portions on either side of the longitudinal axis. In other embodiments, the folded position of each of first member 502 and second member 504 may form different angles.

Figure 10:
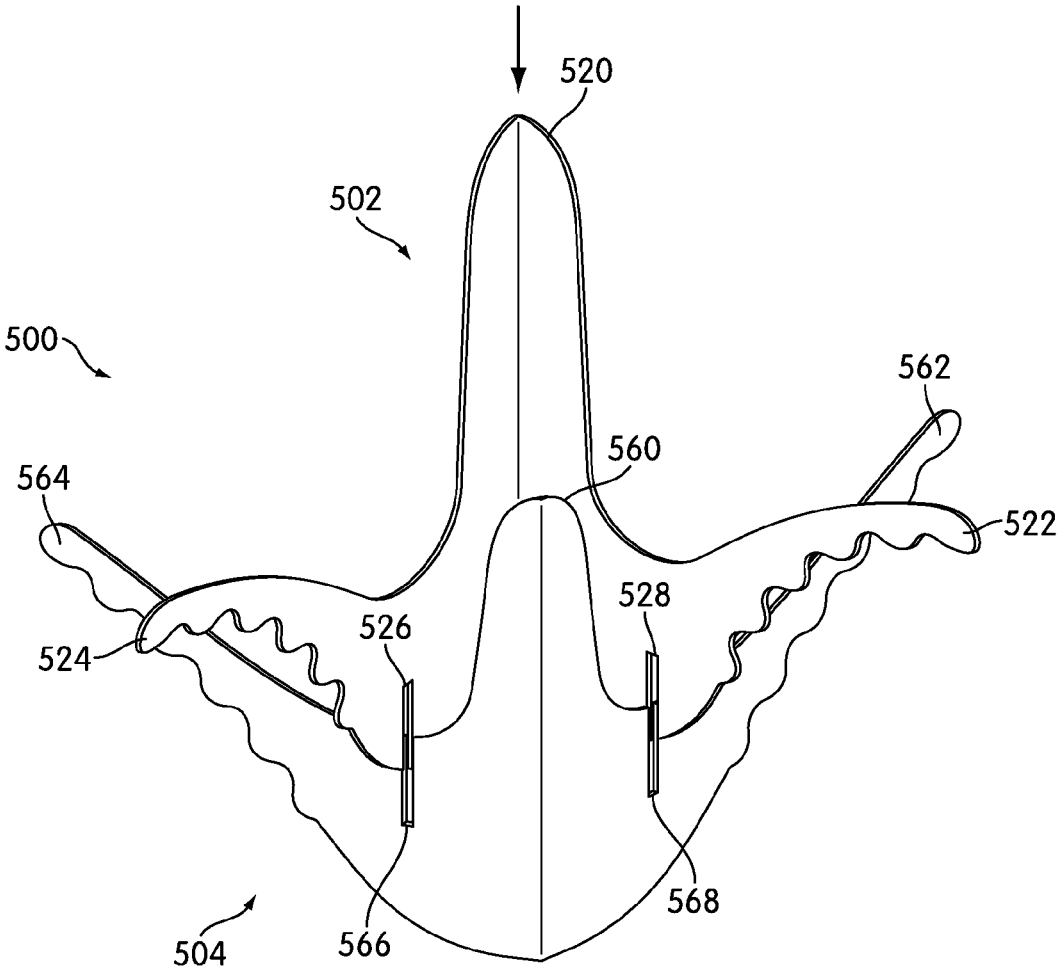
FIG. 10 is an isometric view of an embodiment of the pieces of a stand for a footwear customization system being attached.

As shown in FIG. 10, in a fourth step, first member 502 in a folded position is partially attached to second member 504 in a folded position. First engaging slot 526 of first member 502 may be partially engaged with first receiving slot 566 of second member 504. Similarly, second engaging slot 528 of first member 502 may be partially engaged with second receiving slot 568 of second member 504. First member 502 may continue to be pushed towards second member 504 to fully engage first engaging slot 526 with first receiving slot 566 and second engaging slot 528 with second receiving slot 568.

Figure 11:
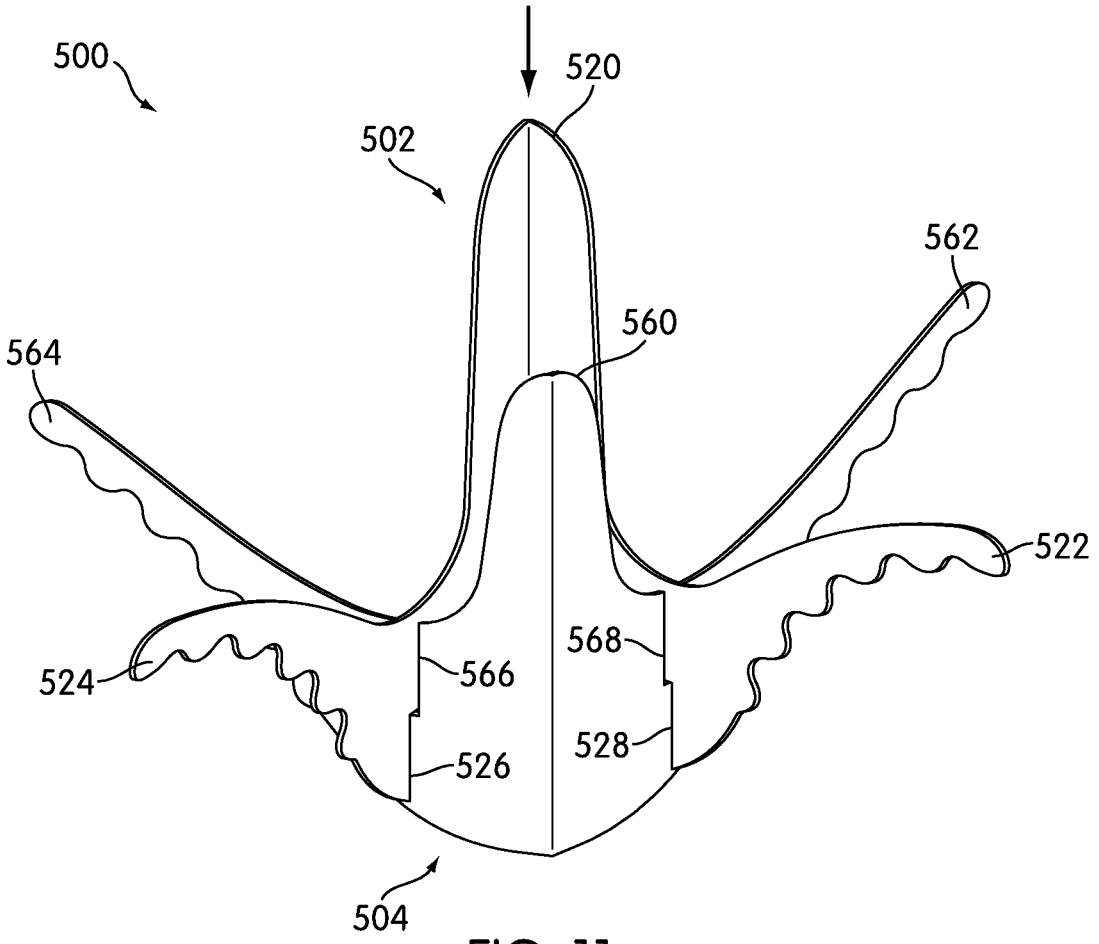
FIG. 11 is an isometric view of an embodiment of an assembled stand for a footwear customization system.

Referring to FIG. 11, stand 500 is shown in an assembled position. In this embodiment, first engaging slot 526 is engaged with first receiving slot 566 and second engaging slot 528 is engaged with second receiving slot 568 to attach first member 502 and second member 504 to form stand 500. As shown in FIG. 11, first arm 522 and second arm 524 extend out from the back of second member 504 and third arm 562 and fourth arm 564 extend out from the back of first member 502. As discussed above, first center projection 520 and second center projection 560 may be inserted into a throat opening of an article to hold the article in place and in a generally upright position.

In different embodiments, stand 500 can be made of different materials. Examples of different materials that could be used include, but are not limited to: metallic materials, polymer materials including plastics and/or rubbers, wooden materials, composite materials, as well as any other kinds of materials. In some cases, a deformable sheet material could be used, such as a deformable plastic sheet material or a deformable metallic sheet material. In other cases, however, stand 500 could be made of any other kind of material. In other embodiments, stand 500 could be made of more than one material. In some cases, stand 500 could be made of a material that can withstand the temperatures associated with the steam environment.

FIGS. 12 through 18 illustrate an exemplary embodiment of a method of customizing article 202 using the components of kit 100. For purposes of clarity, the method is only illustrated using article 202, however it will be understood that similar steps may be repeated to customize second article of footwear 204.

Figure 12:
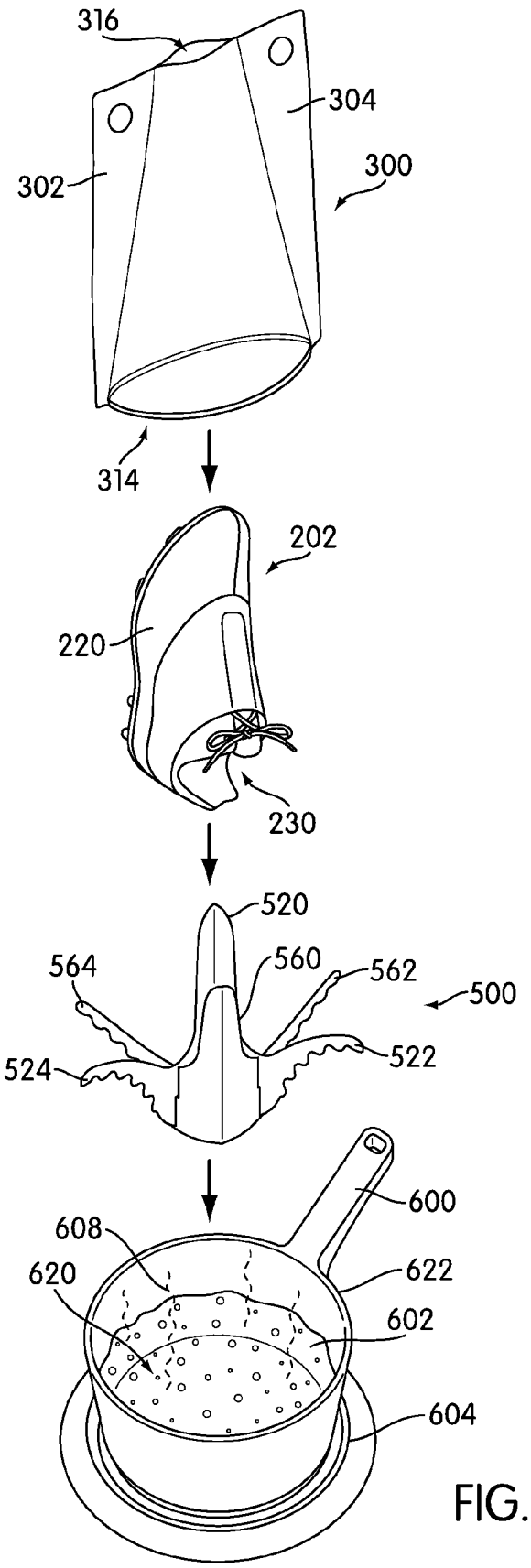
FIG. 12 is an isometric view of an embodiment of the components of a footwear customization kit being positioned in a steam environment.

Referring to FIG. 12, stand 500, article 202 and steaming bag 300 may be associated with a steam environment. In the current embodiment, the steam environment comprises pot 600, which is filled with water 602 and further placed on burner 604. Generally, any kind of pot may be used. In some cases, a user may select a pot that is large enough to accommodate the components of kit 100. In addition, in other embodiments a user may not use a pot. Instead, a user could use any vessel that is capable of containing boiling water. Furthermore, in still other embodiments other types of steaming devices could be used for producing a steam environment.

As water 602 is boiled, steam 608 can be produced for heating article 202 and specifically customizable portion 220. The components shown here can be assembled in any order. In the exemplary embodiment, stand 500 may be first placed on pot 600. Stand 500 may include first arm 522, second arm 524, third arm 562, and fourth arm 566 for resting against an outer periphery 622 of pot 600 to hold stand 500 above water 602 in the interior portion 620 of pot 600. After stand 500 is disposed over water 602 in pot 600, then article 202 can be placed on stand 500. As previously discussed, first center projection 520 and second center projection 560 of stand 500 may be inserted into throat opening 230 of article 202.

Figure 13:
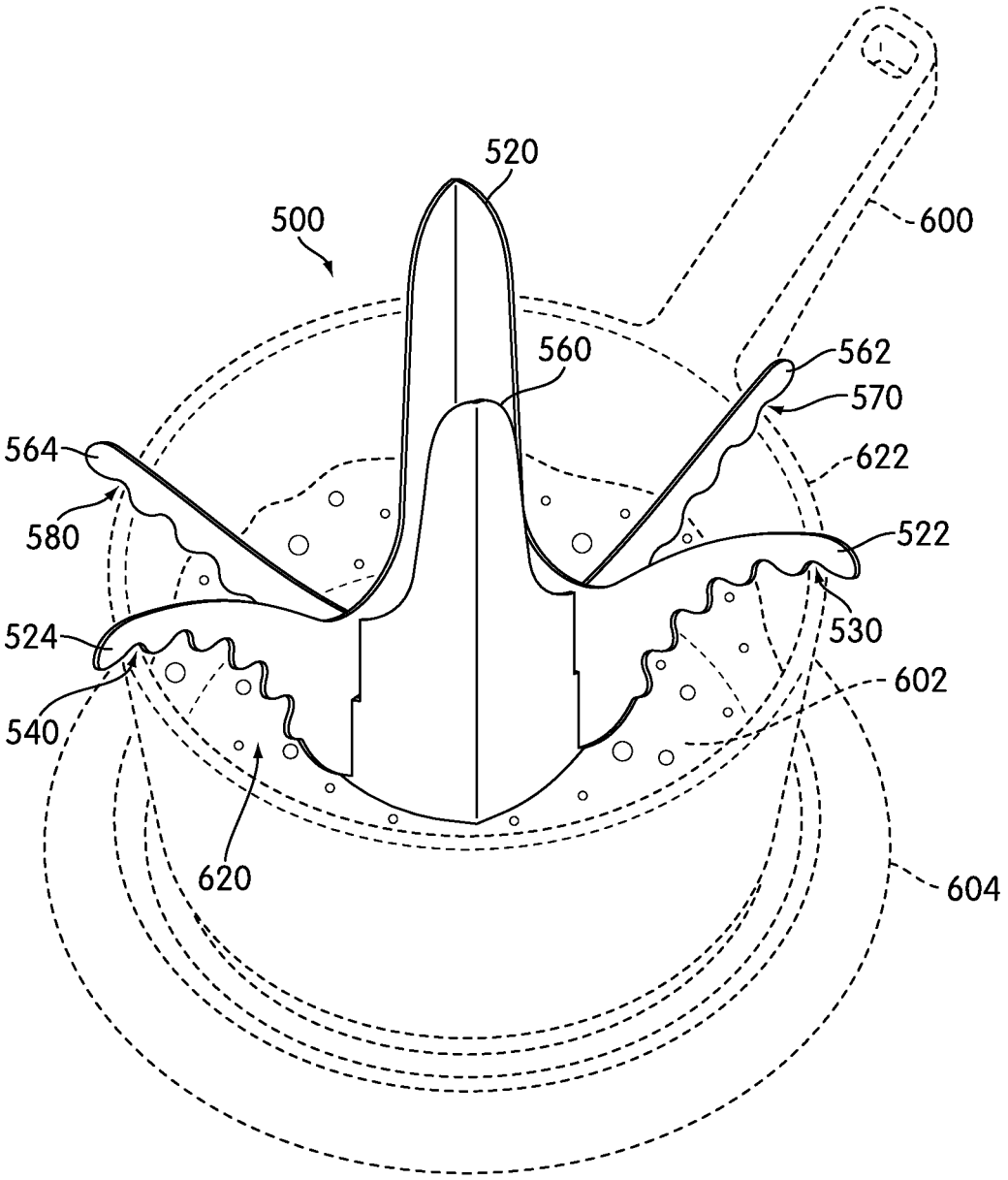
FIG. 13 is an isometric view of an embodiment of a stand for a footwear customization system positioned within a steam environment.

As seen in FIG. 13, stand 500 may include first arm 522 with a first valley 530, second arm 524 with a sixth valley 540, third arm 562 with an eleventh valley 570, and fourth arm 564 with a sixteenth valley 580. First valley 530, sixth valley 540, eleventh valley 570, and sixteenth valley 580 rest against a portion of outer periphery 622 of pot 600. As discussed above, first arm 522 and second arm 524 of first member 502 can be aligned differently than third arm 562 and fourth arm 564 of second member 504 to cause stand 500 to sit off-center within the interior portion 620 of pot 600. In this embodiment, first center projection 520 and second center projection 560 of stand 500 hold article of footwear 202 in an approximately centered position in the interior portion 620 of pot 600. In some cases, first arm 522 and second arm 524 may be aligned approximately the same as third arm 562 and fourth arm 564. In other embodiments, stand 500 need not sit off-center within the interior portion 620 of pot 600. In other embodiments, stand 500 may hold article of footwear 202 in any position within interior portion 620 of pot 600.

In various embodiments, different combinations of first valley 530, second valley 532, third valley 534, fourth valley 536, fifth valley 538, sixth valley 540, seventh valley 542, eighth valley 544, ninth valley 546, tenth valley 548, eleventh valley 570, twelfth valley 572, thirteenth valley 574, fourteen valley 576, fifteenth valley 578, sixteenth valley 580, seventeenth valley 582, eighteenth valley 584, nineteenth valley 586, and twentieth valley 588 on first arm 522, second arm 524, third arm 562, and fourth arm 564 of stand 500 may be used to rest against an outer periphery of vessels of different sizes.

Figure 14:
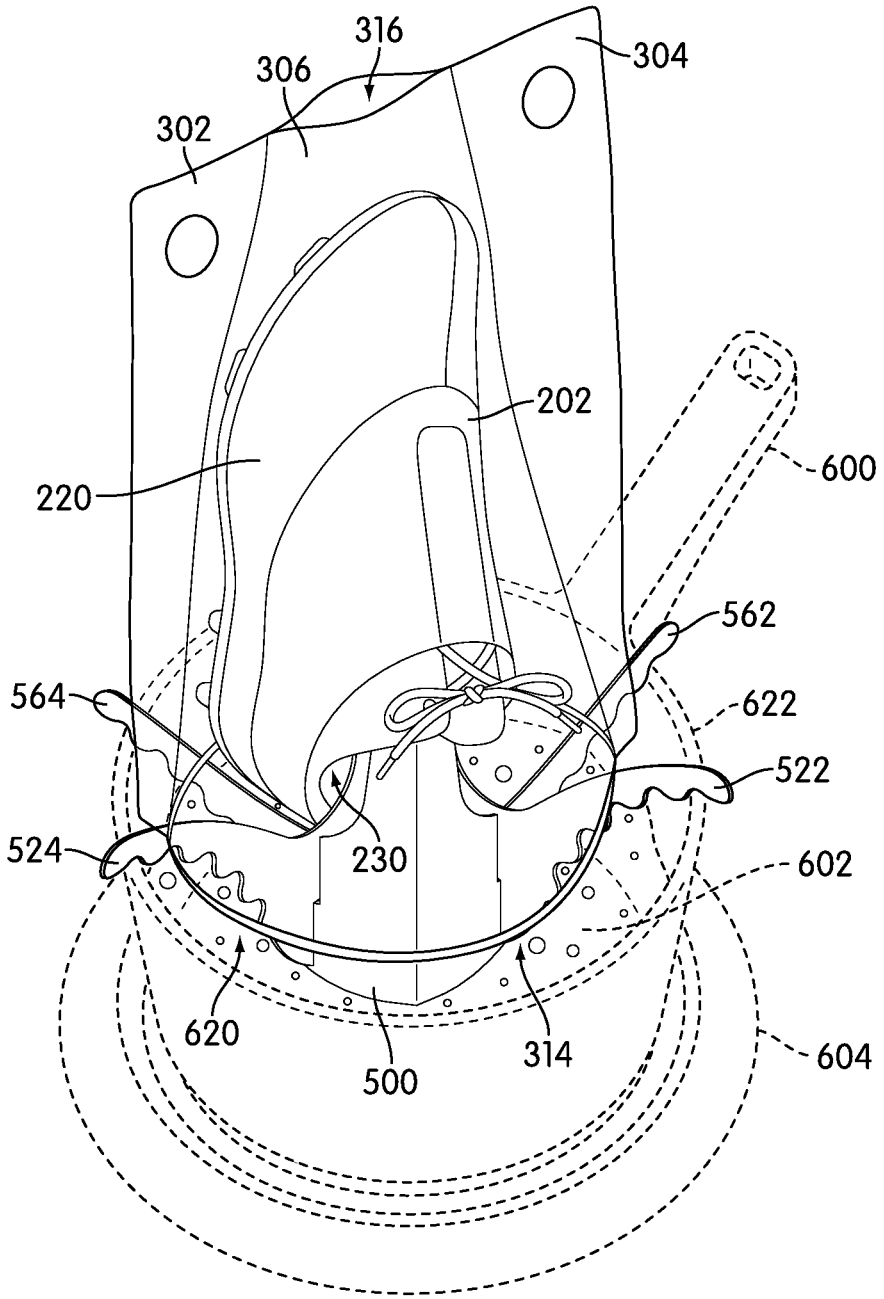
FIG. 14 is an isometric view of an embodiment of the components of a footwear customization kit positioned within a steam environment.

Referring to FIG. 14, in this embodiment, steaming bag 300 may be placed over article 202 and portions of stand 500. As previously discussed, first arm 522, second arm 524, third arm 562, and fourth arm 564 of stand 500 are configured to rest against outer periphery 622 of pot 600. In the current embodiment, peripheral opening 314 may be placed within pot 600 towards interior portion 620. In an exemplary embodiment, peripheral opening 314 may cover a substantial majority of the surface area of water 602 in order to collect a majority of steam 608 coming from water 602. In some other embodiments, first peripheral opening 314 of steaming bag 300 can be configured to engage outer periphery 622 of pot 600 so that no steam escapes around steaming bag 300.

In some embodiments, stand 500 may be disposed close to or within water 602. In some cases, therefore, it is desirable that stand 500 comprise a material that will withstand the high temperatures of water 602. In some cases, stand 500 may be capable of being heated above the boiling point of water.

It is desirable that the components are assembled within pot 600 prior to water 602 boiling. Therefore, once the components of kit 100 are assembled within pot 600, a user may turn on burner 604 to heat water 602 and create a steam environment for article 202.

Figure 15:
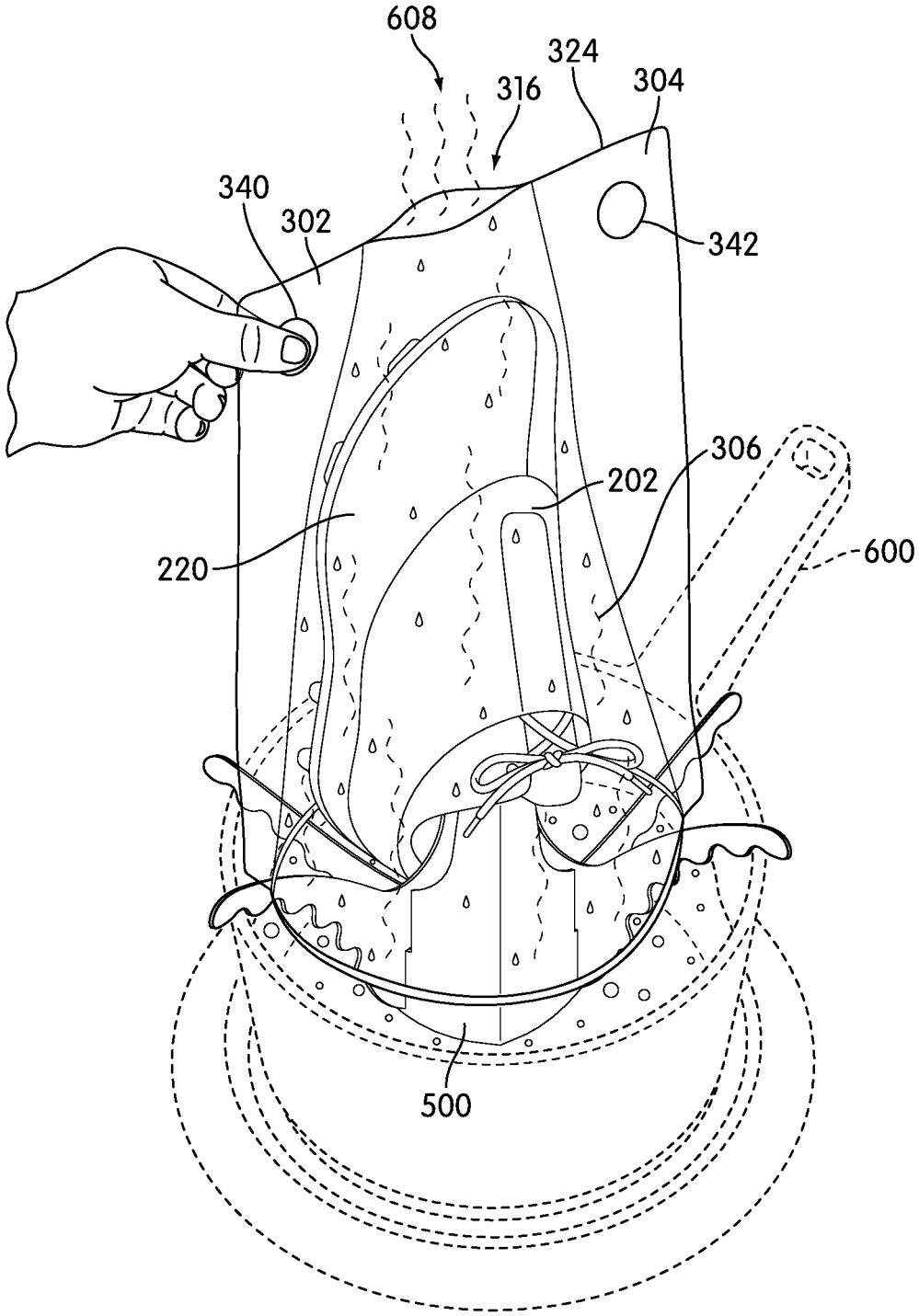
FIG. 15 is an isometric view of an embodiment of a steaming bag being removed from an article of footwear.

Referring now to FIG. 15, steam 608 may be collected within steaming bag 300 in order to heat customizable portion 220. In some embodiments, steam 608 may be applied for a predetermined amount of time. For example, in one embodiment set of instructions 400 (see FIG. 4) can include information about the amount of time that article 202 should be steamed. In some cases, a user could use a timer to keep track of the length of time that article 202 is exposed to steam 608. In other embodiments, a user may take temperature measurements inside of steaming bag 300 to determine if customizable portion 220 has been heated above a predetermined temperature. For example, in one embodiment set of instructions 400 can include information about the predetermined temperature so that a user can determine when an article has been heated to a temperature that is above the predetermined temperature. In still other embodiments, a combination of timing methods and temperature measuring methods could be used to determine when an article has been heated above a predetermined temperature.

In some cases, vent 316 may be provided to release steam from steaming bag 300. In other cases, however, no vent may be provided on fourth peripheral edge 324. In still other cases, other vents or holes could be provided at different locations on steaming bag 300.

After a predetermined period of time, steaming bag 300 may be removed from article 202 and stand 500. In some cases, a user can grasp first peripheral portion 302 and/or second peripheral portion 304 to avoid grasping central portion 306 directly. With central portion 306 filled with steam, first peripheral portion 302 and second peripheral portion 304 may have substantially lower temperatures than central portion 306. In addition, in some cases, a user may place his or her fingers through first grasping hole 340 and/or second grasping hole 342. This configuration allows a user to remove steaming bag 300 easily in a safe and effective manner.

Figure 16:
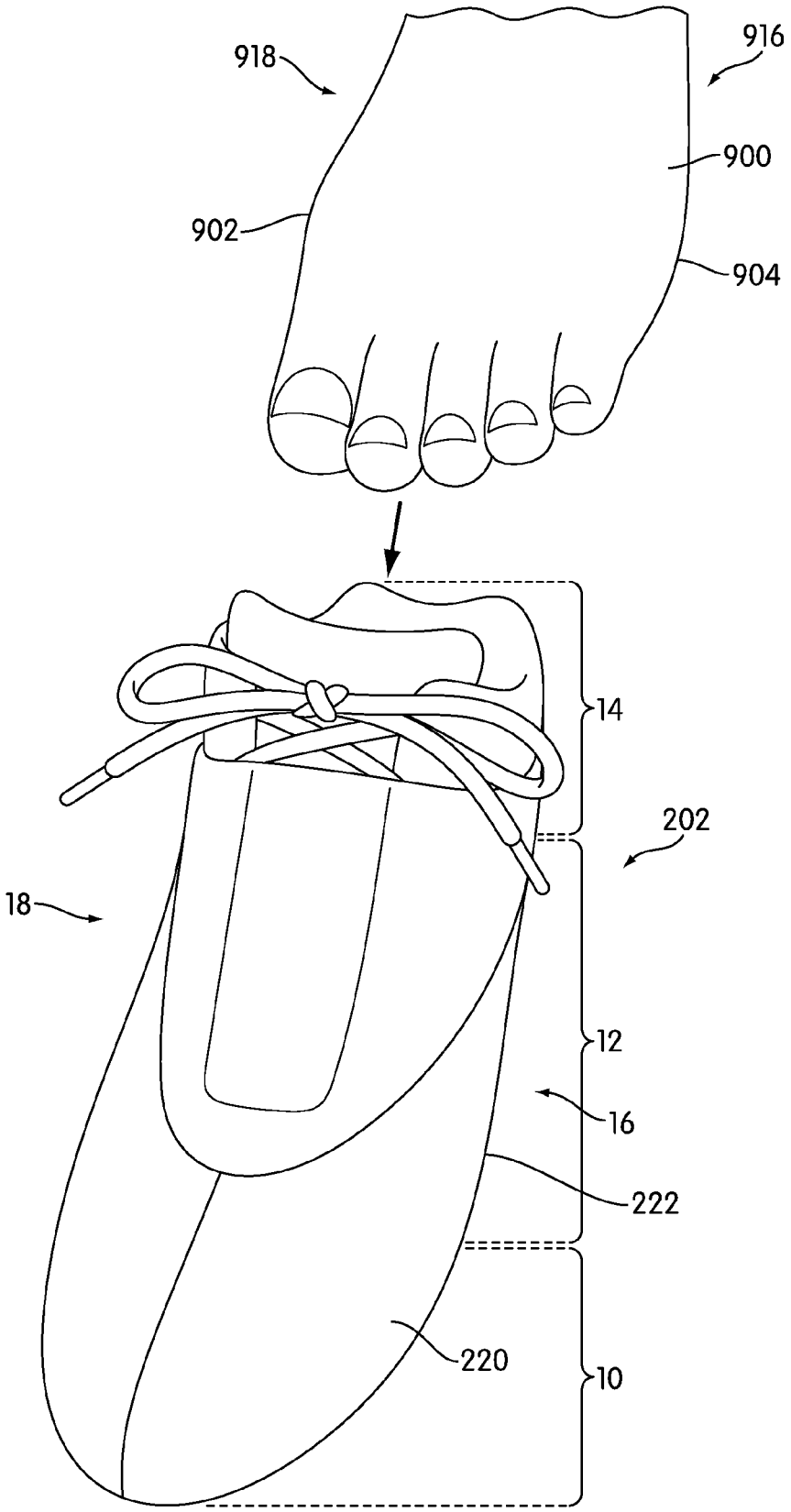
FIG. 16 is an isometric view of an embodiment of an article of footwear in a heated condition and a foot preparing to insert into the article of footwear.
Figure 17:
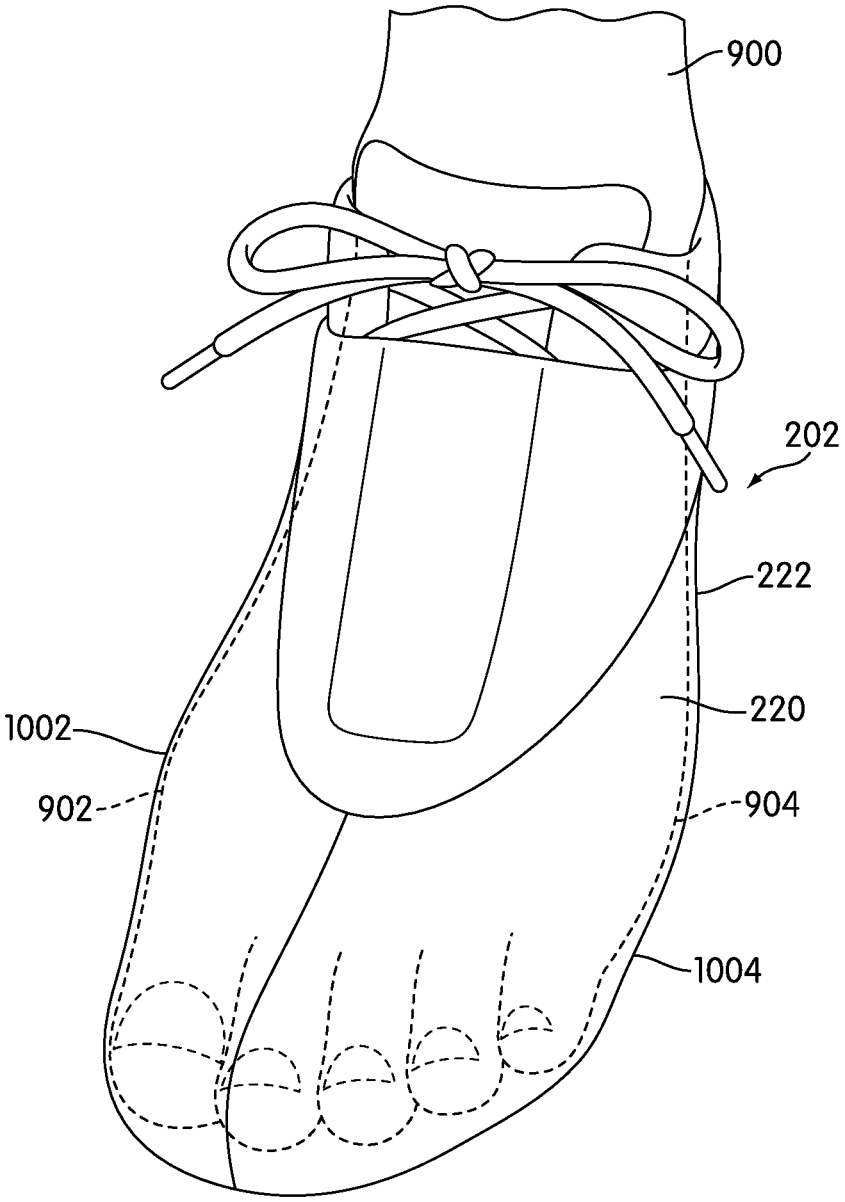
FIG. 17 is an isometric view of an embodiment of an article of footwear with a customizable portion conforming to the contours of a foot.
Figure 18:
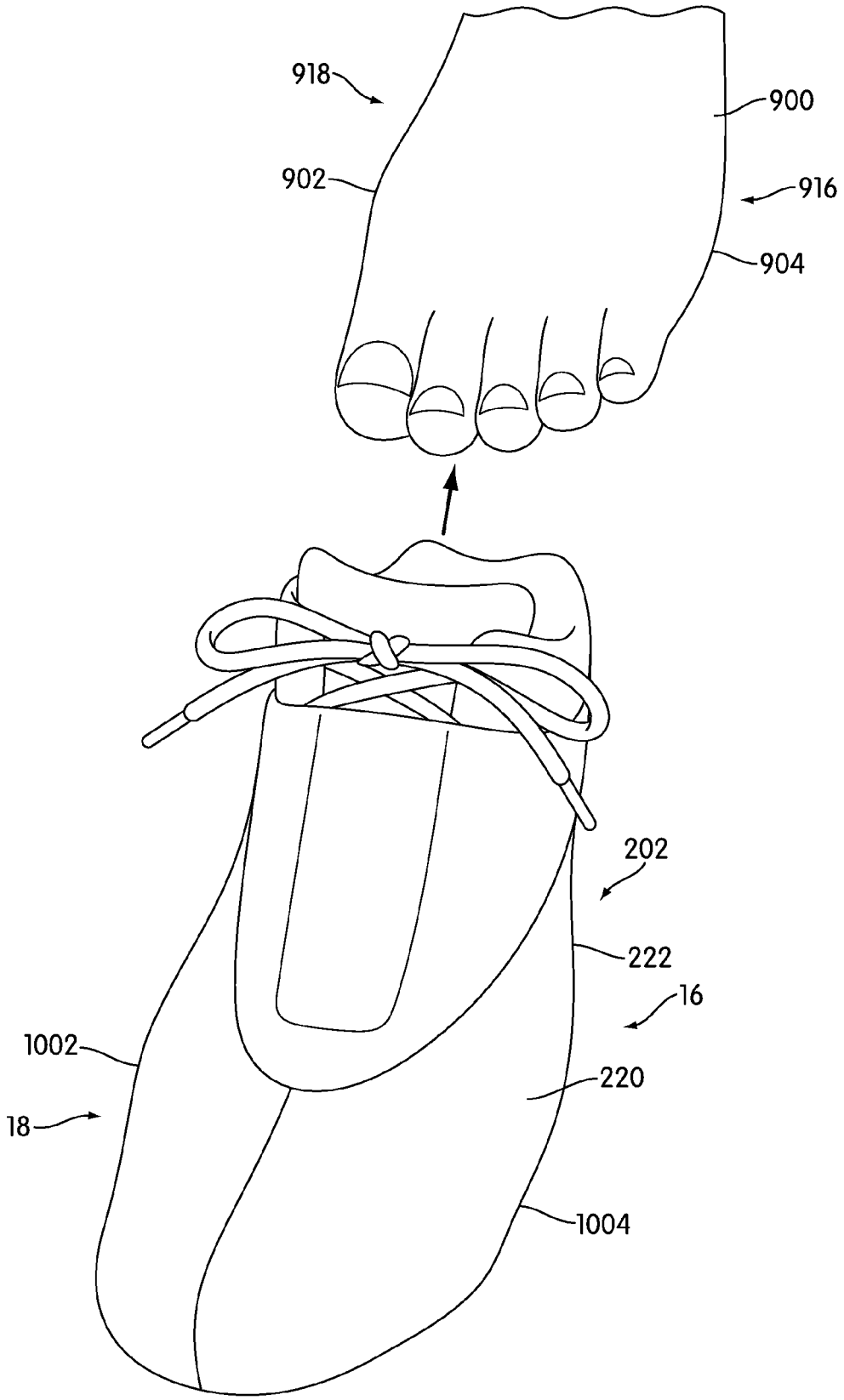
FIG. 18 is an isometric view of an embodiment of an article of footwear with a customizable portion retaining a customized geometry after a foot has been removed.

FIGS. 16 through 18 illustrate isometric views of an embodiment of a customizable portion of an article conforming to the shape of a foot. As previously discussed, the current embodiment includes customizable portion 220 that comprises a substantial majority of upper 222 of article 202. Therefore, as a foot is inserted into upper 222, a substantial majority of upper 222 may conform to the shape of the foot.

Referring to FIG. 16, for purposes of reference, article 202 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 202 may include lateral side 16 and medial side 18. In particular, lateral side 16 and medial side 18 may be opposing sides of article 202. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 202. Likewise, lateral side 16 and medial side 18 are intended to represent generally two sides of an article, rather than precisely demarcating article 202 into two halves. In addition, forefoot portion 10, midfoot portion 12 and heel portion 14, as well as lateral side 16 and medial side 18, can also be applied to individual components of an article, such as a sole structure and/or an upper.

Referring to FIG. 16, the temperature of article 202 may be above the predetermined temperature at which customizable portion 220 softens substantially. In this heated state, customizable portion 220 may be partially deformable. Initially, customizable portion 220 has a substantially smooth shape. In particular, forefoot portion 10 is generally smooth on both lateral side 16 and medial side 18 of upper 222.

Foot 900 is illustrated as inserting into article 202. In contrast to the substantially smooth shape of customizable portion 220, foot 900 has a substantially irregular shape. In this case, foot 900 includes first protrusion 902 and second protrusion 904 associated with medial side 918 and lateral side 916, respectively, of foot 900. These protrusions could be associated with any type of irregularities in the shape of foot 900 including any kinds of bony protrusions, calluses or other types of protrusions.

Referring now to FIG. 17, foot 900 has been fully inserted into upper 222. Furthermore, the temperature of article 202 is still above the predetermined temperature associated with customizable portion 220. In this heated state, customizable portion 220 may be deformed. In an exemplary embodiment, customizable portion 220 may deform so as to adapt to the shape of foot 900. Customizable portion 220 may be reshaped due the pressure applied by foot 900. For example, first contoured portion 1002 of customizable portion 220 may be formed from the local pressure applied by first protrusion 902. In other words, first contoured portion 1002 may be configured with a substantially similar geometry to first protrusion 902. In particular, first contoured portion 1002 may form a protrusion on upper 222 that corresponds to first protrusion 902 on foot 900. In a similar manner, second contoured portion 1004 of customizable portion 220 may be formed from the local pressure applied by second protrusion 904. In other words, second contoured portion 1004 may be configured with a substantially similar geometry to second protrusion 904. In particular, second contoured portion 1004 may form a protrusion on upper 222 that corresponds to second protrusion 904 on foot 900.

It should be understood that a customizable portion could adapt to any geometric features of a foot. In some cases, the customizable portion may adapt to protrusions of various kinds. Additionally a customizable portion can adapt to the overall shape and geometry of a foot. For example, in an embodiment where a user has relatively wide arch, a customizable portion comprising a portion of the upper may be configured to expand at the arch to provide a better fit for the user. In other words, a customizable portion can be deformed to accommodate global geometric features of a foot in addition to local geometric features such as protrusions.

In order to ensure that customizable portion 220 is substantially permanently deformed in a manner that corresponds to foot 900, it is desirable that article 202 cool below the predetermined temperature before removing foot 900. In some cases, a user could make a temperature measurement of article 202. In other cases, a user may wait a predetermined period of time before removing article 202 to ensure that article 202 has sufficiently cooled. In some embodiments, a set of instructions could provide information for a user including a desired amount of time for keeping a foot inserted inside an article of footwear.

After article 202 has cooled below the predetermined temperature, foot 900 can be removed from upper 222, as illustrated in FIG. 18. Customizable portion 220 may substantially retain the shape corresponding to foot 900 following the removal of foot 900. In this case, customizable portion 220 retains first contoured portion 1002 and second contoured portion 1004 even after foot 900 as been removed. With this arrangement, upper 222 may be substantially permanently reshaped to provide a better fit and enhanced comfort for the user.

In some embodiments, the process of reshaping a customizable portion may only occur once over the lifetime of an article. In some cases, for example, a customizable portion may be made of a material that can only be cured a single time. In other words, the cycle of heating the customizable portion above a predetermined temperature, deforming the customizable portion and then cooling the customizable portion below the predetermined temperature can only occur once. Such materials may not return to a substantially deformable state after being reheated above the predetermined temperature. In other embodiments, however, the process of reshaping a customizable portion could occur two or more times over the lifetime of an article.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A footwear customization kit, comprising:

a container for containing an article of footwear;

a stand for holding the article of footwear in a steam environment; and a steaming bag configured to cover the article of footwear and the stand in the steam environment;

wherein the stand includes:

a first member including at least two engaging slots; and a second member including at least two receiving slots;

wherein the first member and the second member each have a flattened position and a folded position;

wherein the first member in the folded position is configured to be attached to the second member in the folded position by engagement of the at least two engaging slots with the at least two receiving slots; and wherein the first member further includes a first arm and a second arm and the second member further includes a third arm and a fourth arm, the first arm, the second arm, the third arm, and the fourth arm being collectively configured to support the stand and the article of footwear in the steam environment.

2. The footwear customization kit according to claim 1, wherein each of the first arm, the second arm, the third arm, and the fourth arm further includes at least one valley collectively sized and configured to grasp an outer periphery of a vessel for holding water.

3. A footwear customization kit comprising:

an article of footwear including a portion that can be deformed when heated;

a container generally sized to hold the article of footwear;

a stand having a first configuration for storing the stand with the article of footwear in the container, and a second configuration for supporting the article of footwear in a steam environment;

a steaming bag having a first configuration for storing the steaming bag with the article of footwear and the stand in the container, and a second configuration for covering the article of footwear and the stand in the steam environment;

wherein the stand includes a first member including at least two engaging slots, and a second member including at least two receiving slots; and wherein the first member further includes a first arm and a second arm and the second member further includes a third arm and a fourth arm, the first arm, the second arm, the third arm, and the fourth arm being collectively configured to support the stand and the article of footwear in the steam environment.

4. The footwear customization kit of claim 3, wherein the stand in the first configuration has a substantially flattened configuration, and the stand in the second configuration has a three dimensional configuration; and wherein the steaming bag in the first configuration has a substantially flattened configuration, and the steaming bag in the second configuration has an opening and interior cavity sized and shaped to receive the article of footwear and the stand.

* * * * *